US010976031B2

(12) United States Patent
Portinga et al.

(10) Patent No.: US 10,976,031 B2
(45) Date of Patent: Apr. 13, 2021

(54) ADJUSTABLE LIGHTING DEVICE WITH BASE CONNECTOR

(71) Applicant: Troy-CSL Lighting Inc., City of Industry, CA (US)

(72) Inventors: Joshua Portinga, Chino Hills, CA (US); Calvin Wong, Diamond Bar, CA (US)

(73) Assignee: Troy-CSL Lighting Inc., City of Industry, CA (US)

( * ) Notice: Subject to any disclaimer, the term of this patent is extended or adjusted under 35 U.S.C. 154(b) by 0 days.

(21) Appl. No.: 16/437,392

(22) Filed: Jun. 11, 2019

(65) Prior Publication Data

US 2020/0393112 A1 Dec. 17, 2020

(51) Int. Cl.

| | |
|---|---|
| ***F21V 23/02*** | (2006.01) |
| ***F21V 29/77*** | (2015.01) |
| ***F21V 5/04*** | (2006.01) |
| ***F21V 17/02*** | (2006.01) |
| ***F21V 14/06*** | (2006.01) |
| ***F21V 14/04*** | (2006.01) |
| ***F21V 23/06*** | (2006.01) |
| ***F21V 23/00*** | (2015.01) |
| ***F21V 29/70*** | (2015.01) |
| *F21Y 115/10* | (2016.01) |

(52) U.S. Cl.

CPC ..... *F21V 17/02* (2013.01); *F21V 14/04* (2013.01); *F21V 14/06* (2013.01); *F21V 23/003* (2013.01); *F21V 23/06* (2013.01); *F21V 29/70* (2015.01); *F21Y 2115/10* (2016.08)

(58) Field of Classification Search

CPC ..... F21V 17/02

See application file for complete search history.

(56) References Cited

U.S. PATENT DOCUMENTS

| | | | | |
|---|---|---|---|---|
| 3,124,309 | A | 3/1964 | Cantoni et al. | |
| 5,274,535 | A | 12/1993 | Gonser | |
| 5,404,297 | A | 4/1995 | Birk et al. | |
| 5,833,346 | A | 11/1998 | Denley | |
| 8,398,271 | B2 | 3/2013 | Chan | |
| 9,255,676 | B2 * | 2/2016 | Hoog | F21S 8/026 |
| 9,618,163 | B2 | 4/2017 | Power et al. | |

(Continued)

FOREIGN PATENT DOCUMENTS

| | | | |
|---|---|---|---|
| CN | 201637870 | U | 11/2010 |
| CN | 201779470 | U | 3/2011 |

(Continued)

OTHER PUBLICATIONS

Extended European Search Report dated Apr. 23, 2020, from Application No. 19217434.0.

(Continued)

*Primary Examiner* — Joseph L Williams
*Assistant Examiner* — Jacob R Stern
(74) *Attorney, Agent, or Firm* — Foley & Lardner LLP

(57) ABSTRACT

A lighting device assembly includes: a heat sink; a light source attached to one end of the heat sink; an optic assembly to pivot an optic about the light source; and a housing member having a cavity in which at least a portion of the optic assembly is received. The optic is to be telescopically adjusted within the optic assembly to adjust a focal point between the light source and the optic.

18 Claims, 13 Drawing Sheets

(56) References Cited

U.S. PATENT DOCUMENTS

| | | | | |
|---|---|---|---|---|
| 9,664,353 | B2 * | 5/2017 | Maliar | F21S 41/635 |
| 9,982,855 | B1 * | 5/2018 | Tan | F21V 29/77 |
| 10,145,519 | B1 | 12/2018 | Portinga | |
| 2004/0124487 | A1 | 7/2004 | Loh | |
| 2008/0036397 | A1 | 2/2008 | Hockel et al. | |
| 2008/0074883 | A1 | 3/2008 | Li | |
| 2008/0158894 | A1 | 7/2008 | Dixon et al. | |
| 2009/0290351 | A1 | 11/2009 | Chan | |
| 2011/0164422 | A1 | 7/2011 | Chan | |
| 2011/0267834 | A1 | 11/2011 | Potucek et al. | |
| 2012/0156920 | A1 | 6/2012 | Sakai et al. | |
| 2012/0162985 | A1 | 6/2012 | Kauffman et al. | |
| 2012/0182723 | A1 | 7/2012 | Sharrah et al. | |
| 2012/0243229 | A1 | 9/2012 | Cheng et al. | |
| 2013/0076269 | A1 | 3/2013 | Shilton | |
| 2013/0107549 | A1 | 5/2013 | Yeh | |
| 2014/0313727 | A1 | 10/2014 | Dupre et al. | |
| 2014/0313737 | A1 | 10/2014 | Watson | |
| 2014/0355273 | A1 | 12/2014 | Saito | |
| 2015/0092417 | A1 | 4/2015 | Hoog | |
| 2015/0117040 | A1 | 4/2015 | Hartmann et al. | |
| 2015/0300612 | A1 | 10/2015 | Stathes et al. | |
| 2015/0369430 | A1 | 12/2015 | Vamberi | |
| 2016/0025319 | A1 | 1/2016 | Meyer | |
| 2016/0363747 | A1 | 12/2016 | Krijn et al. | |
| 2017/0074488 | A1 | 3/2017 | Fujisawa et al. | |
| 2017/0114984 | A1 | 4/2017 | Dross | |
| 2017/0122534 | A1 | 5/2017 | Ticktin et al. | |
| 2017/0307196 | A1 | 10/2017 | Matsui | |
| 2019/0063736 | A1 | 2/2019 | Zeng et al. | |
| 2020/0132278 | A1 | 4/2020 | Portinga | |
| 2020/0200377 | A1 | 6/2020 | Portinga et al. | |

FOREIGN PATENT DOCUMENTS

| | | | |
|---|---|---|---|
| CN | 201779520 | U | 3/2011 |
| CN | 201982999 | U | 9/2011 |
| CN | 201983139 | U | 9/2011 |
| CN | 202125815 | U | 1/2012 |
| CN | 202132746 | U | 2/2012 |
| CN | 202274433 | U | 6/2012 |
| CN | 103162149 | A | 6/2013 |
| CN | 103982877 | A | 8/2014 |
| CN | 106838824 | A | 6/2017 |
| JP | S63-185746 | U | 11/1988 |
| JP | 4400886 | B2 | 1/2010 |
| JP | 2011-192494 | | 9/2011 |
| JP | 2012-069370 | A | 4/2012 |
| JP | 2015-185389 | A | 10/2015 |
| JP | 6164928 | B2 | 7/2017 |
| JP | 2017-212231 | A | 11/2017 |
| WO | WO-01/02775 | | 1/2001 |
| WO | WO-2013/014888 | A1 | 1/2013 |

OTHER PUBLICATIONS

Final Office Action dated Jun. 12, 2020, from U.S. Appl. No. 16/175,470.

Final Office Action dated Mar. 24, 2020, from U.S. Appl. No. 15/828,243.

Hung, et al., "Digital LED Desk Lamp with Automatic Uniform Illumination Area by Using Two Accelerometers and Halftone Method" IEEE ISCE 2014 1569933999.

Ito, Lighting System and Fresnel Lens, Sep. 29, 2011, JP2011192494A, English (Year: 2011).

Minebea, "A revolutionary lighting able to completely control light, created by combining the application of optical technology with precision components", 2017, http://www.minebeamitsumi.com/english/strengths/column/saliot/index.html.

Minebea, "Minebea to Start Mass Production and Sales of New LED Lighting (Smart Adjustable Light for IoT (SALIOT))", Jul. 15, 2015 Press Release, http://www.minebeamitsumi.com/english/news/press/2015/1189602_7564.html.

Non-Final Office Action dated Dec. 2, 2019, from U.S. Appl. No. 16/226,526.

Non-Final Office Action dated Feb. 5, 2020, from U.S. Appl. No. 16/175,470.

Non-Final Office Action dated Sep. 9, 2019, from U.S. Appl. No. 15/828,243.

Notice of Allowance dated Mar. 26, 2020, from U.S. Appl. No. 16/226,526.

Notice of Allowance dated Oct. 2, 2018, from U.S. Appl. No. 15/984,008.

Office Action dated Jul. 5, 2018, from U.S. Appl. No. 15/984,008.

International Search Report and Written Opinion dated Aug. 26, 2020, from application No. PCT/US2020/033651.

Notice of Allowance dated Jan. 13, 2021, from U.S. Appl. No. 16/808,102.

* cited by examiner

ADJUSTABLE LIGHTING DEVICE WITH BASE CONNECTOR

This application is related to U.S. application Ser. No. 15/984,008 (now U.S. Pat. No. 10,145,519), filed on May 18, 2018, which is a continuation of U.S. application Ser. No. 15/828,234, filed on Nov. 30, 2017, both of which are incorporated by reference in their entirety herein. This application is also related to U.S. application Ser. No. 16/175,470, filed on Oct. 30, 2018, and U.S. application Ser. No. 16/226,526, filed on Dec. 19, 2018, both which are incorporated by reference in their entirety herein.

BACKGROUND

Lighting devices such as, but not limited to, track lights or recessed lights, can include configurations that allow for adjustment of the direction of emitted light or light beam. Such lighting devices may include a light source, such as a light emitting diode (LED). Typically, the brightness of an LED light source is at least partially related to the speed in which heat can be transferred away from the LED component, which should desirably be maintained under about 105° Celsius. However, if the LED component is mounted on a moveable structure, such as a free-floating fixture head that is movable to adjust a light beam direction, heat may not be efficiently transferred from the LED component through the moveable structure. Therefore, the brightness of light emitted from the LED light source may be reduced.

If the lighting device has a light source that is mounted directly and in a fixed manner to a fixture housing of substantial mass and suitable heat conductive material, the fixture housing may help to dissipate heat away from the LED light source, to improve LED performance. However, in lighting devices having light sources fixed to fixture housings of sufficient mass for heat dissipation, it may not be possible to adjust the direction of a downlight beam. In addition, if the lighting device includes a fixture head that is moveable together with the optics to adjust the direction of emitted light, some light may be blocked by the bezel or housing containing the optics and light source, when the fixture head is moved.

SUMMARY

One or more examples and aspects described herein relate to an optic assembly having an adjustable optic in which loss of light is reduced. Other examples and aspects described herein relate to a lighting device and a lighting device assembly including that optic assembly. One or more examples and aspects described herein relate to an optic assembly having an adjustable optic in which focus of light is adjusted. Other examples and aspects described herein relate to a lighting device and a lighting device assembly including that optic assembly. One or more examples and aspects described herein relate to various adjustable lighting devices with a standard or proprietary base connector.

According to an example embodiment, a lighting device assembly includes a heat sink, a light source attached to one end of the heat sink, an optic assembly configured to pivot an optic about the light source, and a housing member having a cavity in which at least a portion of the optic assembly is received. The optic is configured to be telescopically adjusted within the optic assembly to adjust a focal point between the light source and the optic.

In some embodiments, the optic assembly may include a holding member configured to receive the optic, the holding member having a curved outer surface configured to slidably engage a curved surface of the cavity of the housing member to pivot the optic about the light source.

In some embodiments, the optic assembly further includes a telescoping sleeve configured to hold the optic within the holding member, the telescoping sleeve configured to slidably engage an interior surface of the holding member to telescopically adjust the optic within the holding member.

In some embodiments, an end of the telescoping sleeve may be configured to extend through an opening of the housing member to telescopically adjust the optic.

In some embodiments, the optic may include a plurality of focal points, and the optic may be configured to be telescopically moved to position the light source at different ones of the focal points to change a focus of emitted light.

In some embodiments, the optic may further include a first focal point within a recess of the optic, and a second focal point outside of the recess of the optic.

In some embodiments, the light source may be received at the first focal point when the optic is in a compressed telescopic position, and the light source may be received at the second focal point when the optic is in an extended telescopic position.

In some embodiments, a maximum pivoting angle of the optic about the light source may be changed depending on a telescopic position of the optic.

In some embodiments, a first maximum pivoting angle of the optic corresponding to when the optic is in a compressed telescopic position may be less than a second maximum pivoting angle of the optic corresponding to when the optic is in an extended telescopic position.

In some embodiments, lighting device assembly may further include: a top member configured to enclose the housing member; and a base connector mounted directly on the top member, the base connector configured to mate with a lamp socket to drive the lighting device assembly.

According to another example embodiments, a lighting device assembly includes a heat sink, a light source attached to one end of the heat sink, an optic assembly configured to pivot an optic about the light source, a housing member having a cavity in which at least a portion of the optic assembly is received, a top member configured to enclose the housing member, and a base connector attached to the top member, the base connector having a cavity to house a driver and electronic circuit to drive the light source.

In some embodiments, the base connector may have an opening to connect the driver and electronic circuit to the light source, and the top member may be configured to cover the opening when the base connector is attached to the top member.

In some embodiments, the base connector may be spaced from the top member via a wire assembly that connects the driver and electronic circuit to the light source.

In some embodiments, the driver and electronic circuit may include a plug-in port, and the base connector may be configured to expose the plug-in port.

In some embodiments, the plug-in port may be configured to receive a plug-in chip, and the plug-in chip may be configured to add data communications functionality to the lighting device assembly.

In some embodiments, the base connector may include a Mogul connector, a Medium connector, a Candelabra connector, or a GU24 connector.

In some embodiments, the optic may be configured to be telescopically adjusted within the optic assembly to adjust a focal point between the light source and the optic In some embodiments, the optic assembly may include: a holding member configured to receive the optic, the holding member having a curved outer surface configured to slidably engage a curved surface of the cavity of the housing member to pivot the optic about the light source; and a telescoping sleeve configured to hold the optic within the holding member, the telescoping sleeve configured to slidably engage an interior surface of the holding member to telescopically adjust the optic within the holding member.

In some embodiments, the optic may include a plurality of focal points, and the optic may be configured to be telescopically moved to position the light source at different ones of the focal points to change a focus of emitted light.

In some embodiments, the optic may include a first focal point within a recess of the optic, and a second focal point outside of the recess of the optic; and the light source may be received at the first focal point when the optic is in a compressed telescopic position, and the light source may be received at the second focal point when the optic is in an extended telescopic position.

BRIEF DESCRIPTION OF THE DRAWINGS

The above and other aspects and features of the present invention will become more apparent to those skilled in the art from the following detailed description of the example embodiments with reference to the accompanying drawings, in which.

DETAILED DESCRIPTION

Figure 1:
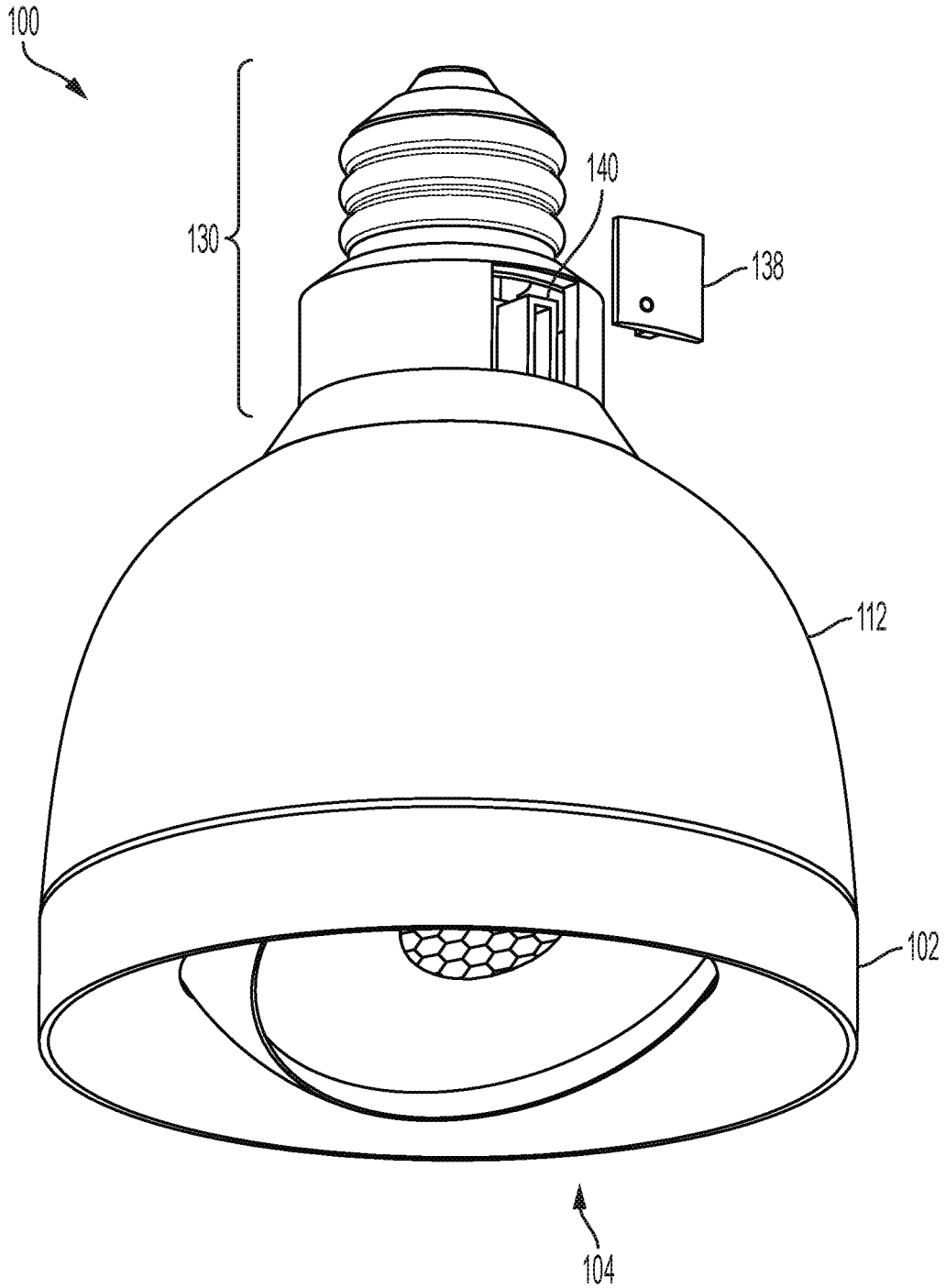
FIG. 1 is a perspective view of an adjustable lighting device, according to various embodiments.

Hereinafter, example embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. Further, features or aspects within each example embodiment should typically be considered as available for other similar features or aspects in other example embodiments.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

According to various embodiments, an adjustable lighting device with a standard or proprietary base connector is provided to simplify conversion of stationary lighting applications to adjustable lighting applications. In some embodiments, an adjustable lighting device with a focus adjustment feature is provided for adjusting a focus of emitted light or light beam. In some embodiments, an adjustable lighting device is provided to improve the adjustability of an optic about a stationary light source and heat sink. In some embodiments, an adjustable lighting device with an improved heat sink is provided for transferring heat away from the light source. In some embodiments, an adjustable lighting device with an improved heat sink is provided for increasing the adjustable movement of the optic.

FIG. 1 is a perspective view of an adjustable lighting device 100, according to various embodiments. In various embodiments, the adjustable lighting device 100 may adjust a direction of emitted light or light beam, and may be configured to be used with a (or any) standard or proprietary light socket. For example, referring to FIG. 1, the lighting device 100 may include a housing member 102, an optic assembly 104, a top member 112, and a connector assembly 130. While FIG. 1 shows one example of a lighting device shape and relative dimensions, other embodiments have other suitable shapes and relative dimensions. For example, the housing member 102 together with the top member 112 are shown in FIG. 1 as generally having portions of a bell shape and relative dimensions, but other embodiments may include other suitable shapes and relative dimensions, including but not limited to cylindrical shapes, curved or partially spherical shapes, conical, cube or cuboid shapes, rectangular shapes, triangular shapes, or the like. In various embodiments, the optic assembly 104 may pivot and/or rotate within the housing member 102 to adjust a direction of the emitted light or light beam. In some embodiments, an optic of the optic assembly 104 may be adjusted telescopically to adjust a focus of the emitted light or light beam.

In various embodiments, the lighting device 100 may be used with a (or any) standard or proprietary light socket without requiring complex installation or additional mounting hardware (e.g., mounting brackets, housing fixtures, and/or the like). For example, as shown in the non-limiting embodiment of FIG. 1, the connector assembly 130 may include a (or any) standard screw base configured to mate with a corresponding standard size screw-in light socket. However, other example embodiments include other standard or proprietary base connectors, for example, such as various pin bases, twist and lock bases, bayonet bases, wedge bases, other suitable screw bases, mogul bases, medium bases, and/or the like. Thus, in some embodiments, the installation of the lighting device assembly 100 may be similar to (and as simple as) changing a standard light bulb. For example, in order to install the lighting device assembly 100 having the standard screw base shown in FIG. 1, an existing light bulb may be unscrewed from a corresponding standard screw-in light socket, and the lighting device assembly 100 may be screwed into the standard screw-in light socket, thereby replacing the light bulb and adding adjustable LED lighting features.

Accordingly, in various embodiments, any existing lighting application having a standard or proprietary light socket connector can be easily and quickly converted into an adjustable lighting application by simply removing the existing light source (e.g., light bulb) from the standard light socket connector, and replacing the existing light source with a lighting device assembly in accordance with various embodiments of the present disclosure having a connector assembly 130 with a corresponding base connector. For example, in various embodiments, the lighting device assembly 100 may be compatible with any suitable light socket attached to an end of an extension member (e.g., a rod or pole), such as in the case of a pendent light, desk light, lamp, and the like. In some other examples, the lighting device assembly 100 may be compatible with any suitable light socket mounted to a surface of an object (such as, but not limited to, a fixture housing, track lighting, downlights, linear lights, board, ceiling, wall, floor, chandelier, ceiling fan, ground lighting, and the like), or that may be recessed (e.g., within an insulated can) into a surface of an object (such as, but not limited to a ceiling, wall, floor, shelf, cabinet, and the like).

In some embodiments, the connector assembly 130 may optionally include an opening that exposes a plug-in port 140 to receive an optional plug-in chip 138. In some embodiments, the optional plug-in chip 138 may mate with the plug-in port 140 to add additional features or functions to the lighting device 100. For example, in some embodiments, the optional plug-in chip 138 may add data communications functionality to the lighting device 100, so that the lighting device 100 can send and receive data over a network (e.g., the Internet, a local area network LAN, Bluetooth, Wifi, WiMax, Near Field Communications (NFC), and/or the like). In some embodiments, the optional plug-in chip 138 may enable the lighting device 100 to communicate with other devices, such as Internet of Things (IoT) devices (e.g., occupancy sensors, motion sensors, light sensors, and/or the like), to control a lighting condition of an environment (e.g., a room or other space). In some embodiments, the optional plug-in chip 138 may be configured to program a processor to monitor and/or control various conditions of the lighting device 100 (e.g., temperature, light output, color of light, direction of light, and/or the like). Accordingly, in various embodiments, the optional plug-in chip 139 may enable the conversion of the lighting device 100 into a smart light or an IoT light.

FIGS. 2-5 are exploded views of adjustable lighting device assemblies, according to various embodiments of the present invention. Referring generally to FIGS. 2-5, each of the lighting device assemblies 200, 300, 400, and 500 may be similar to or the same as the lighting device assembly 100 shown in FIG. 1. For example, each of the lighting device assemblies 200, 300, 400, and 500 may include the housing member 102, the optic assembly 104, the top member 112, and the connector assembly 130. Accordingly, the lighting device assemblies 100, 200, 300, 400, and 500 shown in FIGS. 1-5, respectively, may each be similar or substantially similar to each other, except the structure, size, and/or shape of some of the components (e.g., the housing member 102, the optic assembly 104, heat sink 108, the top member 112, and/or the like) may be variously modified, while some other components may be added or omitted (e.g., the friction member 110, the elastic member 111, and/or the like). Thus, the features or aspects described herein with reference to one or more of the various embodiments of the adjustable lighting device assemblies shown in FIGS. 1-5 should typically be considered as available for other similar features or aspects described with reference to other ones of the various embodiments of the adjustable lighting device assemblies shown in FIGS. 1-5.

Figure 2:
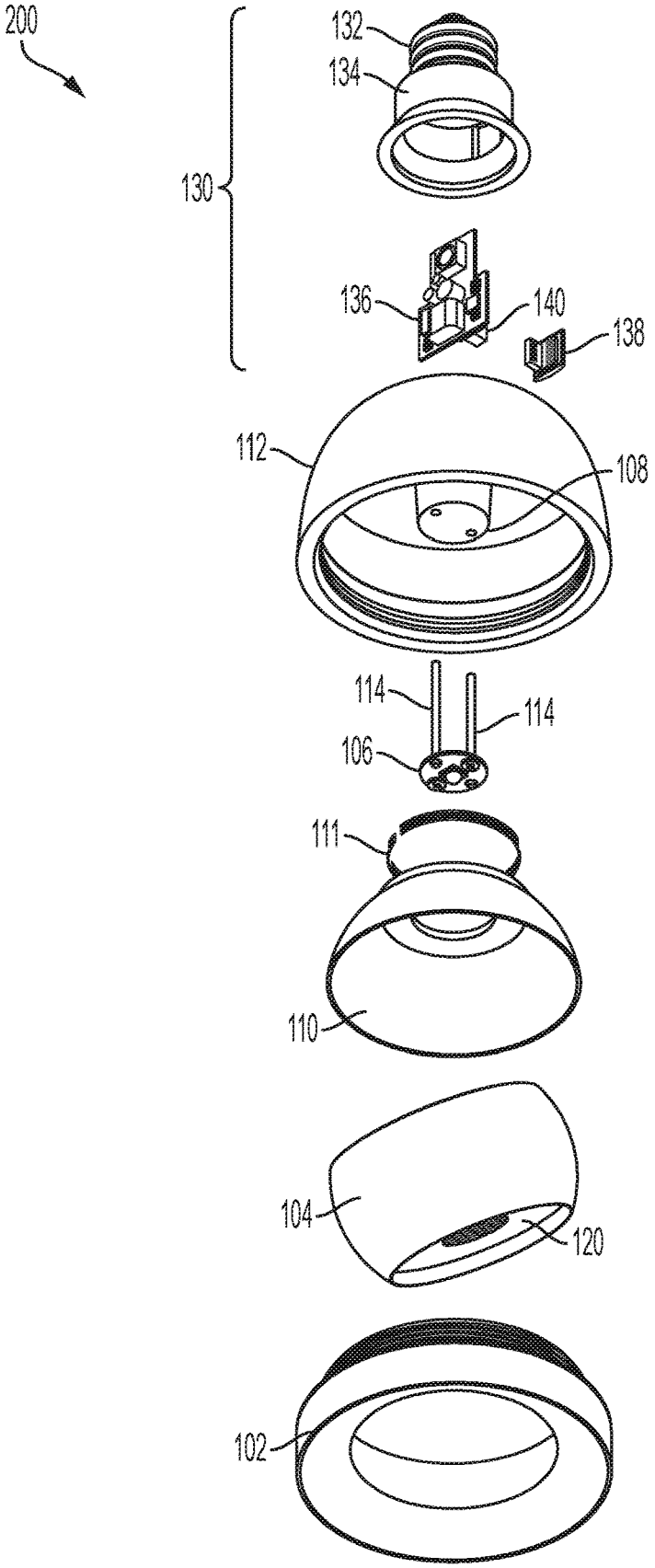
FIGS. 2-5 are exploded views of adjustable lighting device assemblies, according to various embodiments.

For example, as shown in FIG. 2, the lighting device assembly 200 may be similar to or the same as the lighting device assembly 100 shown in FIG. 1. For example, the lighting device assembly 200 may include the housing member 102, the optic assembly 104, the top member 112, and the connector assembly 130. In addition, as shown in FIG. 2, in some embodiments, the lighting device assembly further includes a friction member 110, an elastic member 111, a light source assembly 106, and a heat sink 108. In various embodiments, the heat sink 108 has one or more passageways that extend through a central portion of the heat sink 108, or one or more grooves that extend along a side of the heat sink 108, so that one or more wires 114 for electrically connecting a light source of the light source assembly 106 to the connector assembly 130 may extend through the top member 112 via the heat sink 108. However, in other embodiments, the wires 114 may extend from a side of the top member 112, or the like.

In various embodiments, the optic assembly 104 includes an optic 120 held within the optic assembly 104, and facilitates the movement (e.g., pivot and/or rotation) of the optic 120 relative to the housing member 102. For example, in some embodiments, the optic assembly 104 may slidably engage a cavity of the housing member 102 in a ball and socket manner. In various embodiments, the optic assembly 104 has an outer surface having a curvature that is held within a corresponding cavity (with a corresponding mating curvature and dimension) within the housing member 102. For example, in some embodiments, the outer surface of the optic assembly 104 may have a shape of a portion of a sphere, and may be held within a corresponding sphere-shaped cavity within the housing member 102. Accordingly, the optic 120 (via the optic assembly 104) may pivot in any direction (e.g., on a 360 degree plane) within the housing member 102, by slidably engaging the cavity of the housing member 102. However, the present invention is not limited thereto, and in another embodiment, the pivoting directions of the optic 120 may be limited or reduced, for example, by providing stop surfaces or a shape of the surface of the optic assembly 104 and/or a shape of the cavity within the housing member 102, that limits movement in one or more directions. In various embodiments, the optic assembly 104 may include various suitable components and structures, for example, such as those of any of the optic assemblies 104 described with reference to FIGS. 3-5, the optic assembly 204 described with reference to FIG. 8, or any other suitable components or structures.

In some embodiments, the friction member 110 may provide a friction surface to maintain a pivoted position of the optic 120 and the optic assembly 104 relative to the housing member 102. For example, when the optic 120 is pivoted (with the optic assembly 104) to a desired position within the housing member 102, the friction surface of the friction member 110 frictionally engages an upper surface portion of the optic assembly 104 to prevent or substantially prevent the optic assembly 104 (and thus, the optic 120) from shifting to a different position from the desired position due to gravity (i.e., without manual force). Preferably, the frictional force may be overcome by manual force applied to manually adjust or move (pivot and/or rotate) the optic assembly 104 (and the optic 120) relative to the housing member 102. Accordingly, the friction member 110 or engaging surfaces (e.g., the upper surface portion) of the optic assembly 104 may include any suitable material to provide the friction surface, for example, but not limited to, silicone, rubber, and/or the like. In further examples, the friction surface of the friction member 110 or the engaging surfaces of the optic assembly 104 includes contour, roughness or other features that enhance friction. However, the present invention is not limited thereto, and in some embodiments, the friction member 110 may be omitted. In this case, an interior surface of the cavity of the housing member 102 and/or an exterior surface of the optic assembly 104 may include a friction surface as described above, to maintain a pivoted position of the optic assembly 104 (and the optic 120).

In some embodiments, the friction member 110 may have an internal cavity such that the upper surface portion of optic assembly 104 slidably engages the internal cavity of the friction member 110 in a ball and socket manner. For example, in some embodiments, the internal cavity of the friction member 110 may have a shape of an upper hemisphere of a sphere, so that the engaging surfaces (e.g., the upper surface portion) of the optic assembly 104 can slidably engage the internal cavity of the friction member 110. Thus, in some embodiments, an upper surface portion of the optic assembly 104 may have the curvature (e.g., of an upper hemisphere portion shape) that is partially held within the internal cavity of the friction member 110 such that a portion of the friction member 110 surrounds a portion of the upper surface portion of the optic assembly 104. In this case, when the optic assembly 104 is pivoted, the curvature of the upper surface portion slidably engages a corresponding curvature of the internal cavity of the friction member 110, so that the force exerted thereon (e.g., by the elastic member 111) can be distributed around the upper surface portion to press the optic assembly 104 towards the cavity of the housing member 102, thereby holding the optic assembly 104 at the desired position.

For example, in some embodiments, the elastic member 111 may be a spring (e.g., a wave disk spring, wave spring, disk spring, flat wire spring, coil spring, and/or the like), that exerts a force on the friction member 110 (e.g., at an outer top surface of the friction member 110) to press the friction member 110 against the optic assembly 104, thereby causing the optic assembly 104 to be pressed against the sphere-shaped cavity within the housing member 102. In other embodiments, the elastic member 111 may include a resilient material or other structure that imparts a bias force on the friction member 110 as described herein. For example, in some embodiments, when the optic assembly 104 (and the optic 120) is pivoted or rotated about the light source assembly 106 and/or the heat sink 108, the optic assembly 104 (having the optic 120) may be pressed against the friction member 110 to pivot or rotate the optic 120 to a desired position. Once the optic 120 is at the desired position (and the optic assembly 104 is released from the pressed state), the elastic member 111 extends toward a natural state to exert a force on the friction member 110. The friction member 110 exerts a force on the optic assembly 104, and presses the optic assembly 104 against the cavity within the housing member 102, thereby holding the optic 120 at the desired position. In various embodiments, the elastic member 111 may include or be formed of any suitable material having elasticity and resiliency, for example, such as metal, plastic, or any suitable composite material.

For example, in some embodiments, the elastic member 111 may be located between the outer top surface of the friction member 110 and an inner surface of the top member 112, so that the elastic member is interposed or sandwiched between the friction member 110 and the top member 112. In some embodiments, the outer top surface of the friction member 110 may include a groove or channel in which the elastic member 111 is received. In other embodiments, the outer top surface of the friction member 110 may include a protrusion or platform that is received in an eyelet (e.g., opening, through-hole, groove, or recess) of the elastic member 111. In some embodiments, the force exerted by the elastic member 111 on the friction member 110 is distributed around the outer top surface of the friction member 110, so that the friction member 110 can impart the force on the optic assembly 104 to press the optic assembly 104 towards the housing member 102.

However, in other embodiments (e.g., such as the non-limiting embodiment shown in FIG. 5), the elastic member 111 may be omitted. In this case, for example, to adjust the pivoting (or rotational) direction of the optic assembly 104, the housing member 102 may be loosened from the top member 112. Then, once the optic assembly 104 is adjusted to the desired position, the housing member 102 may be tightened onto the top member 112 (e.g., via a twist-lock motion, snap-lock motion, or the like). When the housing member 102 is tightened onto the top member 112, the housing member 102 may exert a bias force on the optic assembly 104 to press the optic assembly 104 against the cavity of the friction member 110, thereby holding the desired position.

In still other embodiments (e.g., such as the non-limiting embodiments shown in FIGS. 3-4), the friction member 110 may be omitted. In this case, for example, the upper portion of the exterior surface of the optic assembly 104 may slidably engage the eyelet (e.g., opening, through-hole, groove, or recess) of the elastic member 111, such as in a ball and socket manner. In some embodiments, the upper portion of the optic assembly 104 may be partially held within the eyelet of the elastic member 111 such that a portion of the elastic member 111 surrounds a portion of the upper portion of the optic assembly 104. In this case, when the optic assembly 104 is pivoted, the curvature of the upper portion of the optic assembly 104 slidably engages the eyelet to remain within the eyelet of the elastic member 111, so that the force exerted on the optic assembly 104 by the elastic member 111 can be distributed around the upper portion of the optic assembly 104. Accordingly, the optic assembly 104 may be pressed against the cavity of the housing member 102, thereby holding the optic assembly 104 at the desired position.

In various embodiments, the optic 120 may include a recess R or opening (discussed in more detail below with reference to FIG. 6) on a surface facing the light source assembly 106. In some embodiments, the recess R may receive at least a portion of the light source assembly 106. For example, in some embodiments, the heat sink 108 may extend the light source assembly 106 at least partially into the recess R, and the light source assembly 106 may remain at least partially within the recess R throughout the full range of adjustable movement (e.g., pivot and/or rotation) of the optic 120. In other embodiments, the heat sink 108 may extend the light source assembly 106 towards the recess R, but outside the recess R through at least some (or all) of the full range of adjustable movement. In this case, the light source assembly 106 and/or the heat sink 108 may be partially within the recess R throughout some, but not all of the full range of adjustable movement (e.g., pivot and/or rotation) of the optic 120.

Still referring to FIG. 2, in various embodiments, the heat sink 108 may draw heat away from the light source of the light source assembly 106. For example, in some embodiments, the heat sink 108 may be in direct contact with the light source assembly 106 (and, in particular, with the light source) and may transfer heat away from the light source assembly 106 to the top member 112. Accordingly, the heat sink 108 may be made of any suitable material, composition, or layers thereof having sufficient heat transfer and/or dissipation qualities, for example, aluminum, copper, and/or the like. In an example embodiment, the heat sink 108 may be formed (e.g., cast or forged) from solid aluminum.

In various embodiments, the heat sink 108 may have a shape corresponding to an elongated body (e.g., a pedestal) that extends from the top member 112 towards the recess R of the optic 120. Accordingly, in some embodiments, the heat sink 108 may extend through the eyelet of the elastic member 111, through an opening in the top surface of the friction member 110, and through an opening at the top of the optic assembly 104 to extend the light source assembly 106 towards the recess R of the optic 120. For example, in various embodiments, the heat sink 108 may hold the light source assembly 106 at a position in which at least a portion of the light source assembly 106 remains within the recess of the optic 120 throughout some (or all) of the full range of adjustable movement (e.g., pivot and/or rotation), or at a position in which the light source assembly 106 is held just outside of the recess R, such that a portion of the light source assembly 106 and/or the heat sink 108 is received in the recess R throughout some, but not all, of the full range of adjustable movement (e.g., pivot and/or rotation).

Figure 3:
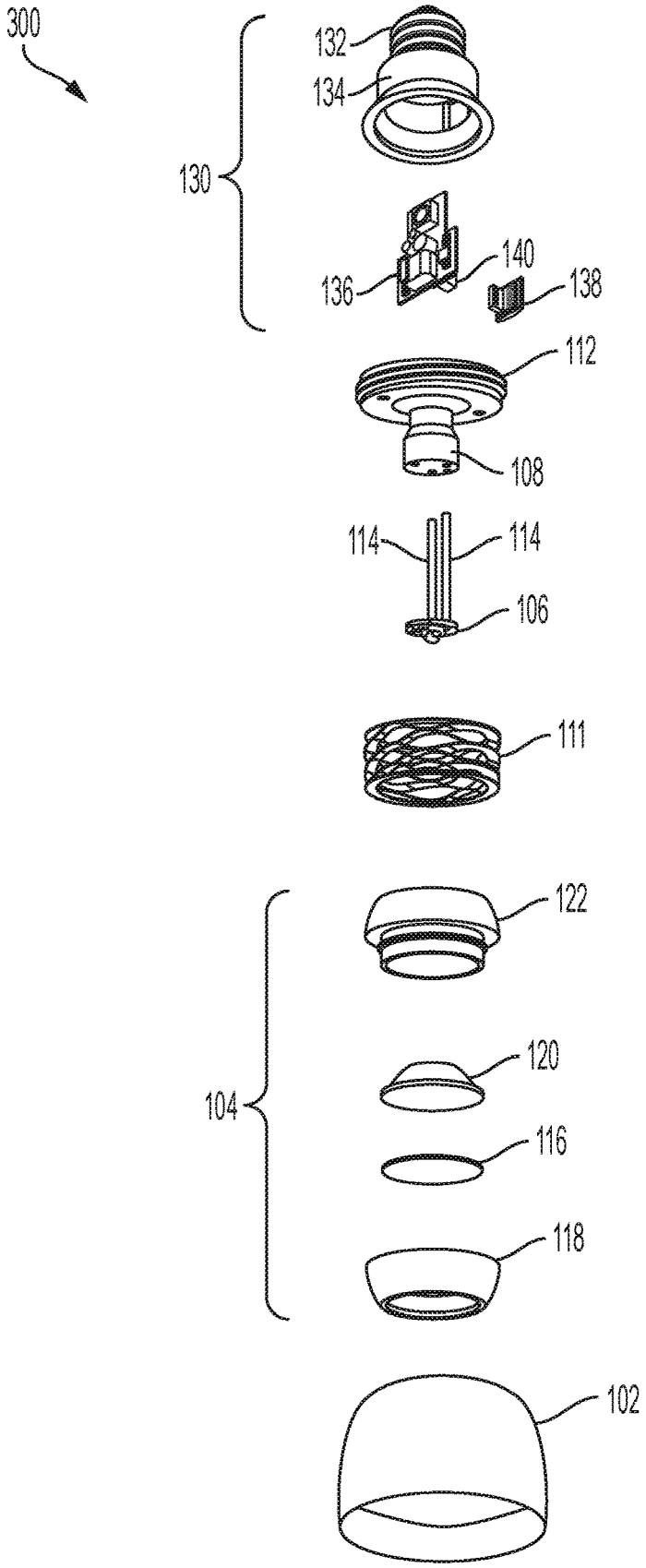
Figure 4:
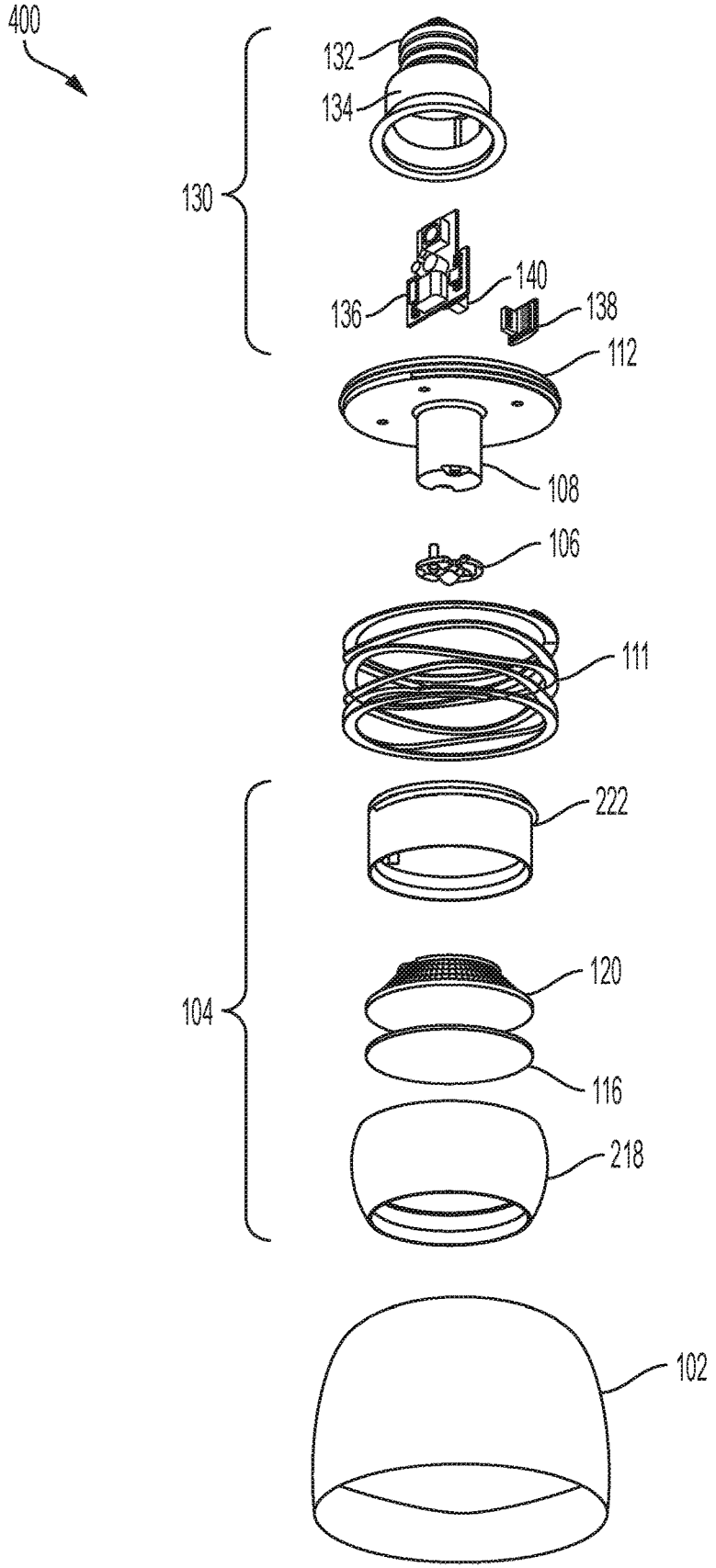
Figure 5:
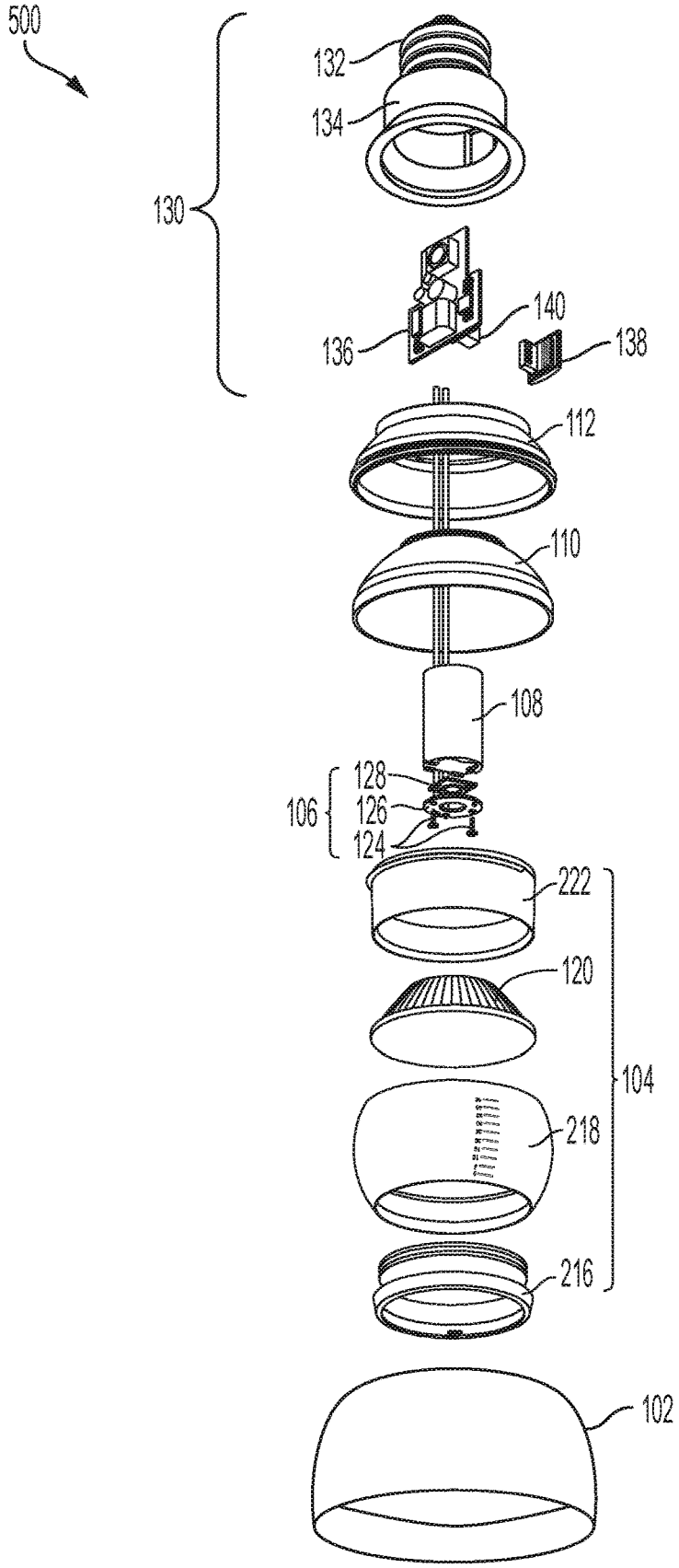

In various embodiments, the heat sink 108 may transfer heat away from the light source of the light source assembly 106 to the top member 112, and in turn, the top member 112 may transfer the heat to the housing member 102. In some embodiments, the top member 112 and/or the housing member 102 may dissipate the heat transferred thereto via the heat sink 108 into the environment (e.g., through an exposed bezel of the housing member 102). Accordingly, in various embodiments, the top member 112 and/or the housing member 102 may be made of any suitable material, composition, or layers thereof having sufficient heat transfer and/or dissipation qualities, for example, aluminum, copper, and/or the like. In an example embodiment, the top member 112 and/or the housing member 102 may be formed (e.g., cast or forged) from solid aluminum. In various embodiments, the heat sink 108 may be integrally formed (e.g., cast or forged) with the top member 112 (e.g., as shown in FIGS. 2-4), or may be separately formed and subsequently attached to the top member 112 (e.g., as shown in FIG. 5). For example, in one example embodiment, the top member 112 and the heat sink 108 may be integrally cast from a block of solid aluminum. On the other hand, in example embodiments where the heat sink 108 is separately formed from the top member 112, the heat sink 108 may be subsequently attached to the top member 112 to be in direct contact with the top member 112 to improve heat transfer characteristics.

In various embodiments, the top member 112 may enclose the top of the housing member 102. For example, in some embodiments, the top member 112 may be connected to the housing member 102 to contain the optic assembly 104 and other components described herein (e.g., friction member 110, elastic member 111, heatsink 108, and/or the like). In various embodiments, the top member 112 may enclose or connect to the housing member 102 by any suitable method, such as, but not limited to, twist-locking (e.g., via threads), snap locking, mating tabs and/or grooves, clips, screws, nails, adhesives, welding, combinations thereof, or the like. In various embodiments, the top member 112 may have various suitable shapes depending on the shape of the housing member 102. For example, as shown in FIG. 2, the top member 112 may have a dome-like shape including a cavity to contain the other components therein. In another example, as shown in FIGS. 3-4, the top member 112 may have a cap (or disk-like shape) when the housing member 102 has a cavity large enough to contain the other components therein. In still another example, as shown in FIG. 5, the top member 112 may have a portion of the dome-like shape and the housing member 102 may have another portion of the dome like shape such that together, the top member 112 and the housing member 102 forms the cavity to contain the other components therein. While FIGS. 1-5 show various example shapes and relative dimensions of the top member 112 and the housing member 102, other embodiments have other suitable shapes and relative dimensions.

In various embodiments, the wires 114 extend through the top member 112 (e.g., via the heat sink 108) to electrically connect the light source assembly 106 (and particularly the light source) to the connector assembly 130. For example, in some embodiments, the connector assembly 130 includes a connector 132, a base 134, a driver and electronics circuit 136, and an optional plug-in chip 138. In some embodiments, the wires 114 may be connected to the driver and electronics circuit 136 to drive the light source of the light source assembly 106. In some embodiments, the base 134 may include an opening to receive the driver and electronics circuit 136, and the wires 114 may be connected to the driver and electronics circuit 136 through the opening. In some embodiments, the connector assembly 130 may be attached or mounted to the top member 112, such that the top member 112 seals the opening. For example, in various embodiments, the connector assembly 130 may contact or be in close contact (e.g., separated by an insulation layer or material) with the top member 112. Thus, in various embodiments, the connector assembly 130 may be attached or mounted to the top member 112 using any suitable method, such as, but not limited to, twist-locking (e.g., via threads), snap locking, mating tabs and/or grooves, clips, screws, nails, adhesives, welding, combinations thereof, or the like. In other embodiments, the connector assembly 130 may not be attached or mounted to the top member 112, and instead, may be spaced apart from the top member 112. For example, in other embodiments, the connector assembly 130 may be connected to the wires 114 via a wire assembly, and may be spaced apart from the top member 112.

In various embodiments, the driver and electronics circuit 136 may include a power supply to convert power provided from a power source to a suitable power for driving a light source of the lighting device. For example, if the light source is a light emitting diode (LED) light source, the driver and electronics circuit 136 may include an LED driver to convert the power from the power source to a low-voltage power suitable to drive the LED light source. In some embodiments, the driver and electronics circuit 136 may include a processor to execute instructions stored on memory (e.g., non-transient computer readable media) to process data and/or to control various functions of the lighting device (e.g., temperature, light output, color of light, direction of light, focus of light, and/or the like). In some embodiments, the processor may be in an inactive state unless the optional plug-in chip 138 (or other device) is received by the driver and electronics circuit 136. In other embodiments, the processor may be in an active state, but some functionality of the lighting device or the processor may be inactivated unless the optional plug-in chip 138 (or other device) is received by the driver and electronics circuit 136.

For example, in some embodiments, the optional plug-in chip 138 may include non-transient computer readable media to provide instructions to operate the processor (or certain functions thereof). In this case, in various embodiments, the optional plug-in chip 138 may include, for example, an SD card, a mini SD card, a microSD card, a USB flash-drive, and/or the like having the instructions stored thereon to activate various functions of the processor and/or the lighting device as described herein. In other embodiments, the optional plug-in chip 138 may include a device or component that adds wireless data communications functionality to the processor of the driver and electronics circuit 136. For example, in some embodiments, the optional plug-in chip 138 may include a radio to enable wireless communications, for example, such as Zigbee, Wi-Fi, Bluetooth, Near Field Communications, cellular, and/or the like. Accordingly, in various embodiments, the optional plug-in chip 138 may add smart capabilities or IoT capabilities to the lighting device as needed or desired. For a non-limiting example, in some embodiments, the optional plug-in chip 138 may enable the lighting device to receive measurement data from a light sensor device to detect the lighting conditions of the environment (e.g., space, room, building, or the like), and the processor of the driver and electronics circuit 136 may analyze the measurement data received from the light sensor device to control a light output of the light source assembly 106.

Accordingly, in some embodiments, the driver and electronics circuit 136 may include a plug-in port that is communicably coupled to the processor of the driver and electronics circuit 136 to receive the optional plug-in chip 138. In this case, the plug-in port may include any suitable type of port corresponding to the optional plug-in chip 138. For example, if the optional plug-in chip 138 includes a mini SD card, the plug-in port may include a miniSD slot to receive the miniSD card. Similarly, if the optional plug-in chip 138 includes a USB flash-drive, the plug-in port may include a USB slot. However, the present disclosure is not limited thereto. For example, in other embodiments, the optional plug-in chip may be a cover or dummy chip to simply cover the plug-in port when not in use. In this case, the plug-in port may include any suitable connection port (e.g., USB slot) to connect the driver and electronics circuit 136 to a computing device. For example, in this case, when the computing device is connected to the plug-in port (e.g., via a USB cable), the computing device may program (or reprogram) the processor of the driver and electronics circuit 136 to perform smart capabilities or IoT capabilities, for example, by adding/modifying instructions stored on non-transient computer-readable media of the driver and electronics circuit 136.

In some embodiments, the base 134 may include a cavity to house the driver and electronics circuit 136. In some embodiments, the base 134 may include an opening to expose the plug-in port, so that the optional plug-in chip 138 (or other device) can be received in the plug-in port. However, the present disclosure is not limited thereto, and in other embodiments, the plug-in port and the optional plug-in chip 138 may be omitted. In this case, the base 134 may not have the opening to expose the plug-in port. In various embodiments, the base 134 is attached or mounted to the connector 132 to supply power to the driver and electronics circuit 136. Various non-limiting example embodiments of the connector 132 are described in more detail with reference to FIG. 11.

Referring now more particularly to FIG. 3, the lighting device assembly 300 may be similar to or the same as the lighting device 100 shown in FIG. 1. For example, the lighting device assembly 300 may include the housing member 102, the optic assembly 104, the top member 112, and the connector assembly 130. In addition, as shown in FIG. 3, in some embodiments, the lighting device assembly 300 further includes the elastic member 111, the light source assembly 106, and the heat sink 108. In some embodiments, the optic assembly 104 may include a holding member 118, a lens filter 116, the optic 120 (one or more lens, filter or combination thereof), and a locking member 122. In various embodiments, the lens filter 116 may change a characteristic of emitted light (e.g., color, brightness, focus, polarization, linear spread filter, wall wash filter, baffles, glare guards, snoots, and/or the like). However, the present invention is not limited thereto, and in other embodiments, the lens filter 116 may be formed as a part of the optic 120, or the lens filter 116 may be optional or omitted. In various embodiments, each of the housing member 102, the holding member 118, and the locking member 122 may be formed or include any suitable material, for example, metal, plastic, glass, ceramic, and/or the like, or any suitable composite material thereof.

In some embodiments, the holding member 118 receives the optic 120 (and the optional lens filter 116), and may facilitate the movement (e.g., pivot and/or rotation) of the optic 120 within the housing member 102. For example, the holding member 118 may slidably engage a cavity of the housing member 102 in a ball and socket manner. In various embodiments, the holding member 118 may have an outer surface having a curvature that is held within a corresponding cavity (with a corresponding mating curvature and dimension) within the housing member 102. For example, the outer surface of the holding member 118 may have a shape of a portion of a sphere (e.g., a lower hemisphere portion), and may be held within a corresponding sphere-shaped cavity within the housing member 102. Accordingly, in various embodiments, the optic 120 may pivot in any direction (e.g., on a 360 degree plane) within the housing member 102, by slidably engaging the cavity of the housing member 102 via the holding member 118. However, the present invention is not limited thereto, and in another embodiment, the pivoting directions of the optic 120 may be limited or reduced, for example, by providing stop surfaces or a shape of the surface of the holding member 118 and/or a shape of the cavity within the housing member 102, that limits movement in one or more directions.

In some embodiments, the locking member 122 may lock the optic 120 and the optional lens filter 116 within the holding member 118. For example, still referring to FIG. 3, in some embodiments, the locking member 122 may have an upper portion and a lower portion. The lower portion of the locking member 122 may have a tubular (or ring) shape that extends from the upper portion toward the holding member 118 to mate with the holding member 118. For example, the lower portion of the locking member 122 may lock (e.g., twist-lock) the optic 120 and the optional lens filter 116 at a suitable position within the holding member 118. In various embodiments, the locking member 122 may include an opening through which the light source assembly 106 and/or the heat sink 108 is received to enable pivoting or rotation of the optic 120 about the light source assembly 106 and/or the heat sink 108.

In various embodiments, the elastic member 111 may be a spring (e.g., a wave disk spring, wave spring, disk spring, flat wire spring, coil spring, and/or the like), that exerts a force on the optic assembly 104 (e.g., the upper portion of the locking member 122) to press the optic assembly 104 (e.g., the holding member 118) against the sphere-shaped cavity within the housing member 102. In other embodiments, the elastic member 111 may include a resilient material or other structure that imparts a bias force on the optic assembly 104 as described herein. For example, in various embodiments, when the optic 120 is pivoted or rotated about the light source assembly 106 and/or the heat sink 108, the optic assembly 104 (having the optic 120) can be pressed towards the elastic member 111 to pivot or rotate the optic 120 to a desired position. Once the optic 120 is at the desired position (and the optic assembly 104 is released from the pressed state), the elastic member 111 extends toward a natural state to exert a force on the optic assembly 104, and presses the holding member 118 of the optic assembly 104 against the cavity within the housing member 102, thereby holding the optic 120 at the desired position. In various embodiments, the elastic member 111 may include or be formed of any suitable material having elasticity and resiliency, for example, such as metal, plastic, or any suitable composite material.

For example, in some embodiments, the upper portion of the locking member 122 may slidably engage an eyelet (e.g., opening, through-hole, groove, or recess) in the elastic member 111, such as in a ball and socket manner. In some embodiments, the upper portion of the locking member 122 may have an outer surface having a curvature so that the upper portion of the locking member 122 is partially received in the eyelet of the elastic member 111. For example, in some embodiments, the outer surface of the upper portion of the locking member 122 may have a shape corresponding to a portion of a sphere (e.g., an upper hemisphere portion) that is partially held within the eyelet of the elastic member 111 such that a portion of the elastic member 111 surrounds a portion of the upper portion of the locking member 122. In this case, when the optic assembly 104 is pivoted, the curvature of the upper portion of the locking member 122 slidably engages the eyelet to remain within the eyelet of the elastic member 111 so that the force exerted thereon by the elastic member 111 can be distributed around the upper portion of the locking member 122 to hold the optic assembly 104 at the desired position.

In some embodiments, at least one of the outer surface of the holding member 118 or an interior surface of the cavity of the housing member 102 may include a friction member or a friction material coating to provide a friction surface to maintain a pivoted position of the optic 120 and the optic assembly 104 within the housing member 102. For example, when the optic 120 is pressed and pivoted (with the holding member 118) to a desired position within the housing member 102 and then released, the elastic member 111 presses the optic assembly 104 (with the holding member 118) against the interior surface of the cavity of the housing member 102 so that the engaging surfaces thereof frictionally engages the friction surface, to prevent or substantially prevent the holding member 118 from shifting (or sliding) to a different position from the desired position due to gravity (i.e., without manual force) or due to the force exerted by the elastic member 111. Preferably, the frictional force may be overcome by manual force applied to manually adjust or move (pivot and/or rotate) the optic 120 and the holding member 118 relative to the housing member 102. Accordingly, the friction member or the friction material coating of the engaging surfaces of the holding member 118 and/or the interior surface of the cavity of the housing member 102 may include any suitable material to provide the friction surface, for example, but not limited to, silicone, rubber, and/or the like. In further examples, the friction surface of the engaging surfaces of the holding member 118 and/or the cavity of the housing member 102 includes contour, roughness or other features that enhance friction. However, the present invention is not limited thereto, and the friction surface or friction material coating may be omitted.

Referring now more particularly to FIG. 4, the lighting device assembly 400 may be similar to or the same as the lighting device 100 shown in FIG. 1. For example, the lighting device assembly 400 may include the housing member 102, the optic assembly 104, the top member 112, and the connector assembly 130. In addition, as shown in FIG. 4, in some embodiments, the lighting device assembly 400 may further include the elastic member 111, the light source assembly 106, and the heat sink 108. In some embodiments, the optic assembly 104 may include a holding member 218, the optional lens filter 116, the optic 120 (one or more lens, filter or combination thereof), and a locking member 222. In various embodiments, each of the housing member 102, the holding member 218, and the locking member 222 may be formed or include any suitable material, for example, metal, plastic, glass, ceramic, and/or the like, or any suitable composite material thereof. In some embodiments, the optic assembly 104 shown in FIG. 4 may be similar to the optic assembly 104 shown in FIG. 3. However, as shown in FIG. 4, the holding member 218 includes an outer surface having a lower surface portion and an upper surface portion. The lower surface portion has a shape corresponding to the outer surface of the holding member 118 (e.g., a lower hemisphere portion of the sphere) as described with reference to FIG. 3, and the upper surface portion has a shape corresponding to the outer surface of the upper portion of the locking member 122 (e.g., an upper hemisphere portion of the sphere) as described with reference to FIG. 3.

Accordingly, in some embodiments, the locking member 222 may lock the optic 120 and the optional lens filter 116 within the holding member 218. For example, the locking member 222 may have a tubular (or ring) shape, and may lock (e.g., twist-lock) the optic 120 (and the optional lens filter) at a suitable position within the holding member 218. In various embodiments, the locking member 222 may include an opening through which the light source assembly 106 and/or the heat sink 108 is received to enable pivoting or rotation of the optic 120 about the light source assembly 106 and/or the heat sink 108. However, in other embodiments, the locking member 222 may be omitted. For example, in other embodiments, the optic 120 may have a self-locking (e.g., twist-lock) mechanism to be locked within the holding member 218, and in this case, the locking member 222 may be omitted.

Still referring to FIG. 4, in some embodiments, the holding member 218 receives the optic 120 (and the optional lens filter 116), and may facilitate the movement (e.g., pivot and/or rotation) of the optic 120 within the housing member 102. For example, the lower surface portion of the outer surface of the holding member 218 may slidably engage a cavity (with a corresponding mating curvature and dimension) of the housing member 102 in a ball and socket manner. Accordingly, in various embodiments, the optic 120 may pivot in any direction (e.g., on a 360 degree plane) within the housing member 102, by slidably engaging the cavity of the housing member 102 via the holding member 218. However, the present invention is not limited thereto, and in another embodiment, the pivoting directions of the optic 120 may be limited or reduced, for example, by providing stop surfaces or a shape of the surface of the holding member 218 and/or a shape of the cavity within the housing member 102, that limits movement in one or more directions The upper surface portion of the outer surface of the holding member 218 may slidably engage the eyelet (e.g., through-hole, groove, or recess) of the elastic member 111 in a ball and socket manner. Thus, in some embodiments, the upper surface portion of the holding member 218 may have the curvature (e.g., upper hemisphere portion) that is partially held within the eyelet of the elastic member 111 such that a portion of the elastic member 111 surrounds a portion of the upper surface portion of the holding member 218. In this case, when the optic assembly 204 is pivoted, the curvature of the upper surface portion slidably engages the eyelet to remain within the eyelet of the elastic member 111 so that the force exerted thereon by the elastic member 111 can be distributed around the upper surface portion to hold the optic assembly 204 at the desired position.

In some embodiments, at least one of the outer surface of the holding member 218 or an interior surface of the cavity of the housing member 102 may include a friction member or a friction material coating to provide a friction surface to maintain a pivoted position of the optic 120 and the optic assembly 204 within the housing member 102. For example, when the optic 120 is pressed and pivoted (with the holding member 218) to a desired position within the housing member 102 and then released, the elastic member 111 presses the optic assembly 204 (with the holding member 218) against the interior surface of the cavity of the housing member 102 so that the engaging surfaces thereof frictionally engages the friction surface, to prevent or substantially prevent the holding member 218 from shifting (or sliding) to a different position from the desired position due to gravity (i.e., without manual force) or due to the force exerted by the elastic member 111. Preferably, the frictional force may be overcome by manual force applied to manually adjust or move (pivot and/or rotate) the optic 120 and the holding member 218 relative to the housing member 102. Accordingly, the friction member or the friction material coating of the engaging surfaces of the holding member 218 and/or the interior surface of the cavity of the housing member 102 may include any suitable material to provide the friction surface, for example, but not limited to, silicone, rubber, and/or the like. In further examples, the friction surface of the engaging surfaces of the holding member 218 and/or the cavity of the housing member 102 includes contour, roughness or other features that enhance friction. However, the present invention is not limited thereto, and the friction surface or friction material coating may be omitted.

Referring generally to FIGS. 3-4, in some embodiments, the heat sink 108 and the top member 112 may be similar to the heatsink 108 and the top member 112 shown in FIG. 2, except the structure, size, and/or shape of the heatsink 108 and/or the top member 112 may be variously modified. Accordingly, in various embodiments, the heat sink 108 may be unitarily formed (e.g., cast or forged) with the top member 112, or separately formed and subsequently attached to the top member 112 to be in direct contact with the top member 112, such that the heat sink 108 can transfer heat from the light source assembly 106 to the top member 112. For example, in various embodiments, the heat sink 108 and the top member 112 be made of any suitable material, composition, or layers thereof having sufficient heat transfer and/or dissipation qualities, for example, aluminum, copper, and/or the like. In an example embodiment, the heat sink 108 and the top member 112 may be unitarily formed (e.g., cast or forged) from a block of solid aluminum.

Figure 7:
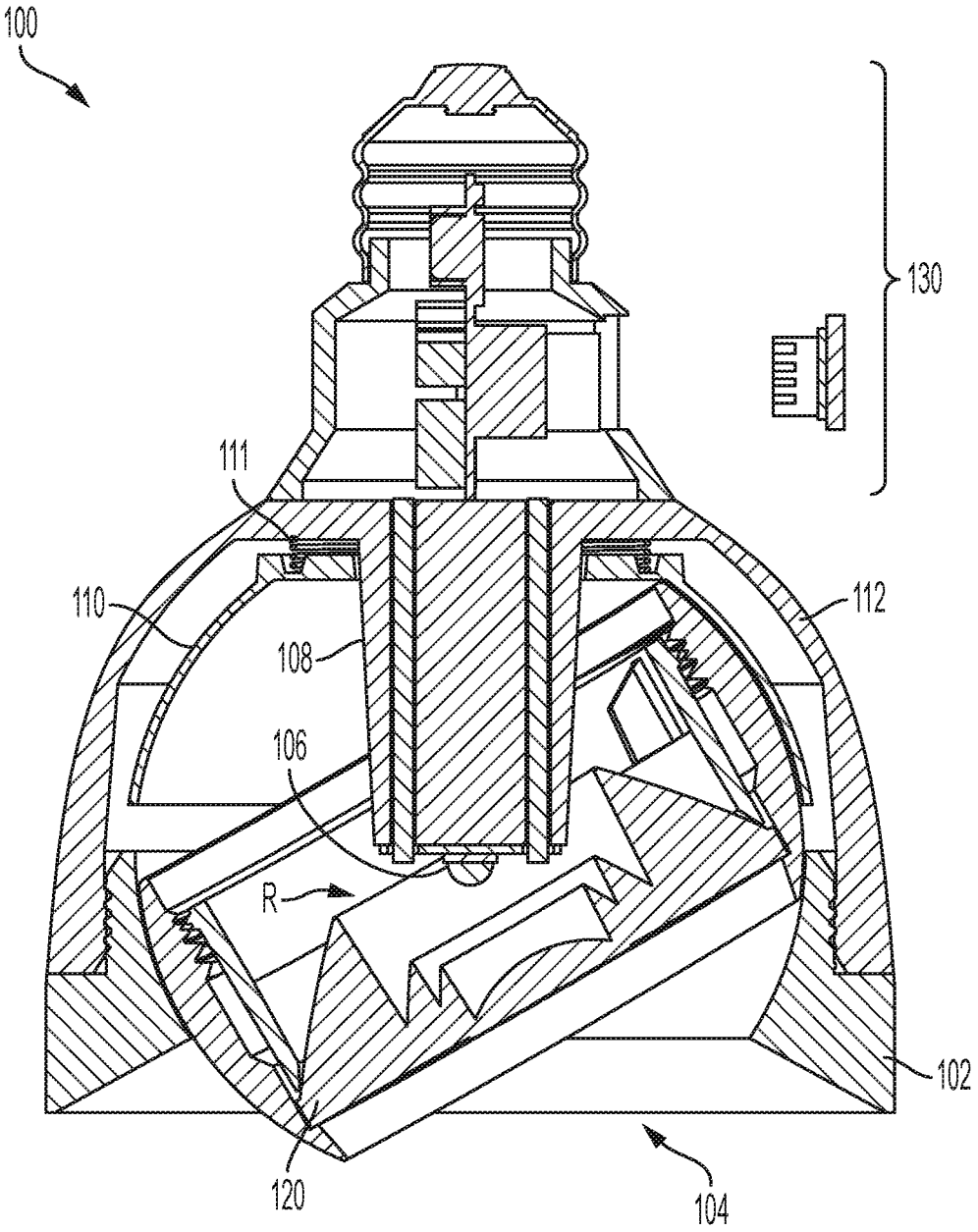
FIG. 7 is a cross-sectional view of the lighting device shown in FIG. 1 with the optic in a pivoted position, according to an example embodiment.

In various embodiments, the heat sink 108 may be sized and/or shaped corresponding to size considerations of the lighting device assembly 100 (e.g., size considerations of the housing member 102, the light source assembly 106, the recess R of the optic 120, and/or the like) and/or the desired range of adjustable motion (e.g., pivot and/or rotation) of the optic 120. For example, a size of an end of the heat sink 108 on which the light source assembly 106 is attached may correspond to a size of the light source assembly 106 (e.g., the area of the circuit board of the light source assembly 106). In another example, as shown in FIG. 3, the heat sink 108 may have a larger circumference (or larger area) at the end where the light source assembly 106 is attached than at an opposite end (e.g., the end extending from or otherwise attached to the top member 112). In this case, the range of adjustable motion (e.g., pivot and/or rotation) of the optic 120 may be increased by providing additional room at the smaller end in which the optic assembly 104 can pivot (or rotate). In other embodiments, as shown in FIGS. 2 and 7, the heat sink 108 may have a larger circumference (or larger area) at the end extending from (or otherwise attached to) the top member 112 than at the end attached to the light source assembly 106. However, the present invention is not limited thereto, and in still other embodiments, as shown in FIGS. 4-5, the heat sink 108 may have a constant circumference (or width) along the length of the heat sink 108.

In various embodiments, the top member 112 may enclose the top of the housing member 102, and may be sized and/or shaped corresponding to size considerations of the lighting device assembly 100 (e.g., size considerations of the housing member 102, the optic assembly 104, and/or the like) and/or the desired range of adjustable motion (e.g., pivot and/or rotation) of the optic 120. For example, as shown in FIGS. 3-4, in example embodiments where the housing member 102 has a size and/or shape that is large enough to house the other components (e.g., the optic assembly 104) therein, the top member 112 may have a disk-like shape to enclose the top of the housing member 102. In other embodiments, as shown in FIG. 2, in example embodiments where the housing member 102 has a disk-like shape, the top member 112 may have a dome-like shape to house the other components (e.g., the optic assembly 104) therein. Accordingly, in various embodiments, the top member 112 may have various suitable shapes, and may be attached to or otherwise connected to the housing member 102 to house the other components (e.g., the optic assembly 104) therein. For example, in various embodiments, the top member 112 may be attached to, or otherwise connected to the housing member 102 using any suitable attachment method, for example, such as twist locking (e.g., via threads), mating tabs and/or grooves, clips, screws, nails, adhesives, welding, combinations thereof, or the like. In various embodiments, the top member 112 may transfer heat away from the light source assembly 106 (via the heat sink 108) to the housing member 102, and the housing member 102 may dissipate the heat into the environment (e.g., via an exposed bezel).

Referring now more particularly to FIG. 5, the lighting device assembly 500 may be similar to or the same as the lighting device 100 shown in FIG. 1. For example, the lighting device assembly 500 may include the housing member 102, the optic assembly 104, the top member 112, and the connector assembly 130. In addition, as shown in FIG. 5, in some embodiments, the lighting device assembly 500 may further include the light source assembly 106, the friction member 110, and the heat sink 108. In some embodiments, the optic assembly 104 may include an optional lens filter 216, the holding member 218, the optic 120 (one or more lens, filter or combination thereof), and the locking member 222. In various embodiments, each of the housing member 102, the holding member 218, and the locking member 222 may be formed or include any suitable material, for example, metal, plastic, glass, ceramic, and/or the like, or any suitable composite material thereof.

In some embodiments, the optic assembly 104 shown in FIG. 5 may be similar to the optic assembly 104 shown in FIG. 4. However, as shown in FIG. 5, the optional lens filter 216 may be attached (e.g., via twist-lock, snap-lock, or the like) to an end of the holding member 218, instead of being contained within the holding member 218. In various embodiments, the lens filter 216 may change a characteristic of emitted light (e.g., color, brightness, focus, polarization, linear spread filter, wall wash filter, baffles, glare guards, snoots, and/or the like). However, the present invention is not limited thereto, and in other embodiments, the lens filter 216 may be formed as a part of the optic 120, or the lens filter 216 may be optional or omitted.

In more detail, as shown in FIG. 5, the holding member 218 receives the optic 120, and may facilitate the movement (e.g., pivot and/or rotation) of the optic 120 within the housing member 102. For example, the lower surface portion of the outer surface of the holding member 218 may slidably engage a cavity (with a corresponding mating curvature and dimension) of the housing member 102 in a ball and socket manner. Accordingly, the optic 120 may pivot in any direction (e.g., on a 360 degree plane) within the housing member 102, by slidably engaging the cavity of the housing member 102. However, the present invention is not limited thereto, and in another embodiment, the pivoting directions of the optic 120 may be limited or reduced, for example, by providing stop surfaces or a shape of the surface of the holding member 218 and/or a shape of the cavity within the housing member 102, that limits movement in one or more directions.

The upper surface portion of the outer surface of the holding member 218 may slidably engage an internal cavity of the friction member 110 in a ball and socket manner. For example, in some embodiments, the internal cavity of the friction member 110 may have a shape of an upper hemisphere of a sphere, so that engaging surfaces (e.g., the upper surface portion) of the holding member 218 can slidably engage the internal cavity of the friction member 110. Thus, in some embodiments, the upper surface portion of the holding member 218 may have the curvature (e.g., upper hemisphere portion) that is partially held within the internal cavity of the friction member 110 such that a portion of the friction member 110 surrounds a portion of the upper surface portion of the holding member 218. In this case, when the optic assembly 104 is pivoted, the curvature of the upper surface portion slidably engages a corresponding curvature of the internal cavity of the friction member 110, so that the force exerted thereon when the housing member 102 is locked (e.g., twist-locked) to the top member 112 can be distributed around the upper surface portion to hold the optic assembly 104 at the desired position.

In some embodiments, the friction member 110 may provide a friction surface to maintain a pivoted position of the optic 120 and the holding member 218 within the housing member 102. For example, when the optic 120 is pivoted (with the holding member 218) to a desired position within the housing member 102, the friction surface of the friction member 110 frictionally engages the upper surface portion of the holding member 218, to prevent or substantially prevent the holding member 218 from shifting to a different position from the desired position due to gravity (i.e., without manual force). Preferably, the frictional force may be overcome by manual force applied to manually adjust or move (pivot and/or rotate) the optic 120 and the holding member 218 relative to the housing member 102. Accordingly, the friction member 110 or the engaging surface of the holding member 218 may include any suitable material to provide the friction surface, for example, but not limited to, silicone, rubber, and/or the like. In further examples, the friction surface of the friction member 110 or the engaging surface of the holding member 218 includes contour, roughness or other features that enhance friction. However, the present invention is not limited thereto, and in some embodiments, the friction member 110 may be omitted. In this case, an interior surface of the cavity of the housing member 102 and/or an exterior surface of the holding member 118 may include a friction surface as described above, to maintain a pivoted position of the optic 120.

Still referring to FIG. 5, in some embodiments, the heat sink 108 and the top member 112 may be similar to the heatsink 108 and the top member 112 shown in FIGS. 2-4, except the structure, size, and/or shape of the heatsink 108 and/or the top member 112 may be variously modified. Accordingly, in various embodiments, the heat sink 108 may be unitarily formed (e.g., cast or forged) with the top member 112, or separately formed and subsequently attached to the top member 112 to be in direct contact with the top member 112, such that the heat sink 108 can transfer heat from the light source assembly 106 to the top member 112. For example, in various embodiments, the heat sink 108 and the top member 112 be made of any suitable material, composition, or layers thereof having sufficient heat transfer and/or dissipation qualities, for example, aluminum, copper, and/or the like. In an example embodiment, the heat sink 108 and the top member 112 may be separately formed (e.g., cast or forged) from solid aluminum, and subsequently attached together in an assembly process. In this case, in some embodiments, the heat sink 108 may be attached (e.g., welded) to the top member 112 to be in direct contact with the top member 112. However, the present disclosure is not limited thereto, and in other embodiments, the heat sink 108 may not be in direct contact with the top member 112.

In various embodiments, the top member 112 may enclose the top of the housing member 102, and may be sized and/or shaped corresponding to size considerations of the lighting device assembly 100 (e.g., size considerations of the housing member 102, the optic assembly 104, and/or the like) and/or the desired range of adjustable motion (e.g., pivot and/or rotation) of the optic 120. For example, as shown in FIG. 5, in example embodiments where the housing member 102 has a size and/or shape corresponding to a portion (e.g., lower half) of the bell-like shape, the top member 112 may have a size and/or shape corresponding to the other portion (e.g., the upper half) of the bell-like shape to enclose the top of the housing member 102. Accordingly, in various embodiments, the top member 112 may have various suitable shapes, and may be attached to or otherwise connected to the housing member 102 to house the other components (e.g., the optic assembly 104) therein. For example, in various embodiments, the top member 112 may be attached to, or otherwise connected to the housing member 102 using any suitable attachment method, for example, such as twist locking (e.g., via threads), mating tabs and/or grooves, clips, screws, nails, adhesives, welding, combinations thereof, or the like. In various embodiments, the top member 112 may transfer heat away from the light source assembly 106 (via the heat sink 108) to the housing member 102, and the housing member 102 may dissipate the heat into the environment (e.g., via an exposed bezel).

In various embodiments, the light source assembly 106 may include a light source 128. The light source 128 may include, for example, one or more light emitting diodes (LEDs), or an array of multiple LEDs. However, the present invention is not limited thereto, and in other embodiments, the light source 128 may include any suitable light source (e.g., LED, incandescent, halogen, fluorescent, combinations thereof, and/or the like). In some embodiments, the light source 128 may emit white light. In other embodiments, the light source 128 may emit any suitable color or frequency of light, or may emit a variety of colored lights. For example, when the light source includes an array of LEDs, each of the LEDs (or each group of plural groups of LEDs in the array) may emit a different colored light (such as, but not limited to white, red, green, and blue), and, in further embodiments, two or more of the different colored lights may be selectively operated simultaneously to mix and produce a variety of different colored lights, or in series to produce light that changes in color over time.

In various embodiments, the light source assembly 106 may further include an attachment element 124 and a frame member 126. The light source 128 may be attached (or mounted) to the heat sink 108 via the attachment element 124 and the frame member 126. For example, the frame member 126 may be arranged over the light source 128, and connected to the heat sink 108 via the attachment element 124 with the light source 128 interposed therebetween. In some embodiments, the frame member 126 may include a circuit board with traces connected to the light source 128 and the wires 114 to drive the light source 128. In some embodiments, the attachment element 124 may include one or more of any suitable attachment elements, for example, a screw, a nail, a clip, an adhesive, and/or the like. However, the present invention is not limited thereto, and in other embodiments, the frame member 126 may be omitted, and the light source 128 may be directly attached (or mounted) to the heat sink 108.

Figure 6:
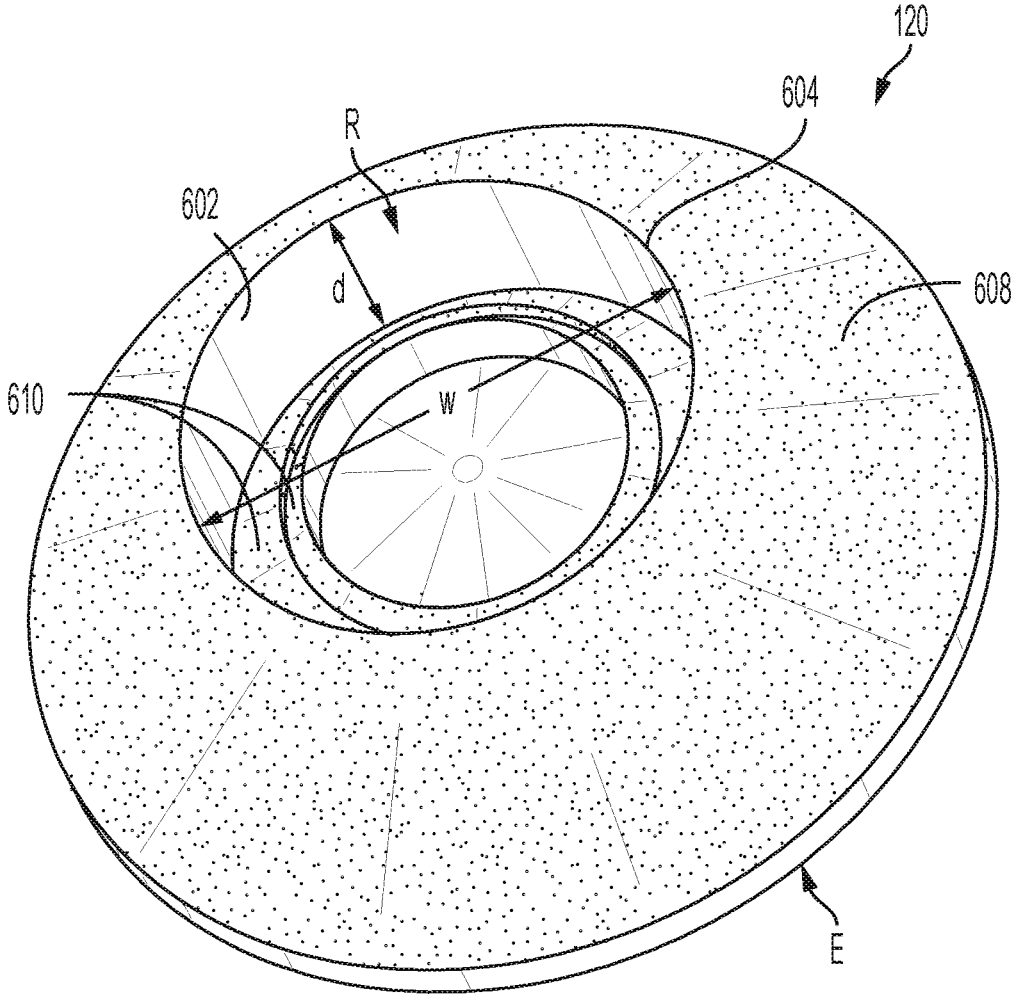
FIG. 6 is a perspective view of an optic of a lighting device assembly, according to an example embodiment.

FIG. 6 is a perspective view of an optic of a lighting device assembly according to an example embodiment of the present invention. Referring to FIG. 6, the optic 120 includes a recess R. In various embodiments, the light source of the light source assembly 106 is extended toward the recess R of the optic 120 by the heat sink 108 to emit light towards the recess R of the optic 120. For example, in some embodiments, the heat sink 108 may extend at least a portion of the light source assembly 106 at least partially into the recess R, and the portion of the light source assembly 106 may remain at least partially within the recess R throughout the full range of adjustable movement (e.g., pivot and/or rotation) of the optic 120. In other embodiments, the heat sink 108 may extend the light source assembly 106 towards the recess R but outside the recess R, and the light source assembly 106 may remain outside of the recess R throughout at least some (or all) of the range of adjustable movement (e.g., pivot and/or rotation) of the optic 120. In various embodiments, the optic 120 is configured to shift (or adjust) a direction of the light emitted from the light source from a first direction to a second direction. In various embodiments, the light source of the light source assembly 106 and the heat sink 108 remains stationary relative to the housing member 102, such that the optic 120 may freely move and pivot relative to and around the light source of the light source assembly 106 and the heat sink 108.

In various embodiments, the optic 120 includes a side wall 602 having a top edge 604 that defines the recess R. A focal point of the optic 120 may be located within a depth d of the recess R, and the recess R may have a diameter (or width) w. In various embodiments, the width (or diameter) w of the recess R may be greater than or equal to the width (or diameter) of the heat sink 108, and may limit a maximum degree amount (e.g., 10°, 30°, 45°, and the like) that the optic 120 can pivot about the light source assembly 106. For example, the maximum degree amount that the optic 120 may pivot about the light source assembly 106 may correspond to the width w of the recess R and a width (or diameter) of the heat sink 108 with respect to the recess R, such that the optic 120 may pivot about the light source assembly 106 until the top edge 604 of the recess R contacts a side wall of the heat sink 108. However, in other embodiments, the width w of the recess R may be smaller than the width (or diameter) of the heat sink 108.

In some embodiments, an upper surface 608 of the optic 120 may include a reflective surface (e.g., provided by a layer or coating of reflective material, contours, or combination thereof) to reflect light towards an emitting surface E of the optic 120. In various embodiments, the bottom surface of the recess R of the optic 120 may include one or more reflective elements 610 to reflect light towards the emitting surface E of the optic 120. In some embodiments, each of the reflective elements 610 may have an inner annular side surface that is perpendicular or substantially perpendicular to a focal axis of the optic 120, and an outer annular side surface that is angled relative to the focal axis of the optic 120. The angle of the outer annular side surface of each of the reflective elements 610 may slope downward (e.g., towards the emitting surface E) and outward (e.g., towards the sidewall 602). In some embodiments, the outer annular side surface may include a reflective surface (e.g., provided by a layer or coating of reflective material, contours, or combination thereof), to reflect light towards the emitting surface E of the optic 120. However, the present invention is not limited thereto, and the reflective elements 610 may have various different suitable shapes or may be omitted.

In some embodiments, the optic 120 may define (or shape) a light field of light emitted through the emitting surface E of the optic 120. For example, in some embodiments, the reflective elements 610 may be configured to refract a portion of incident light that is emitted by the light source of the light source assembly 106 at an angle that is greater than or equal to a critical angle (or critical angle of incidence) with respect to a normal of (perpendicular line from) the emitting surface E of the optic 120. The refracted light may be internally reflected off of the emitting surface E, into and absorbed by other portions (non-transparent portions) of the lighting device (e.g., the housing member 102, the top member 112, and/or the like). However, the portion of the incident light emitted by the light source at an angle that is less than the critical angle passes through the emitting surface E (as emitted light), such that light that is transmitted through the emitting surface E may have an outer light field (area of significantly reduced intensity) that is relatively small and/or more defined (as compared to lighting devices that do not employ an optic configured as described herein).

In some embodiments, the reflective elements 610 may have a size and/or shape depending, at least in part, on the refractive index of the material used to form the reflective elements 610 and the desired critical angle for internally reflecting light. For example, in some embodiments, the reflective elements 610 may include or be formed of a material having a refractive index of about 1.4 (or 1.4) to about 1.6 (or 1.6) to refract the incident light at a critical angle of about 39 degrees (or 39 degrees) or greater. In other embodiments, materials having other suitable refractive indices or that define other suitable critical angles may be employed.

FIG. 7 is a cross-sectional view of the lighting device 100 shown in FIG. 1 with the optic 120 in a pivoted position according to an embodiment of the present invention. The lighting device 100 may be the same as or similar to the lighting devices 200, 300, 400, and 500 described with reference to FIGS. 2-5. For example, referring to FIGS. 1-7, the lighting device 100 includes the housing member 102, the optic assembly 104 held in the cavity of the housing member 102 and including the optic 120, the light source assembly 106, the top member 112 including the heat sink 108, the friction member 110, the elastic member 111, and the connector assembly 130. As shown in FIG. 7, in some embodiments, the heat sink 108 and the top member 112 is unitarily formed (e.g., cast), and the connector assembly 130 is mounted on to the top member 112. In other embodiments (e.g., as shown in FIG. 5), the heat sink 108 and the top member 112 may be separately formed (e.g., cast). In various embodiments, the light source assembly 106 is attached (e.g., mounted) at an end of the heat sink 108, such that the heat sink 108 transfers heat from the light source assembly 106 to an exposed bezel of the housing member 102 via the top member 112. Accordingly, the heat sink 108 may conduct heat away from the light source assembly 106 directly to the exposed bezel of the housing member 102 via the top member 112. In some embodiments, the end of the heat sink 108 on which the light source assembly 106 is attached (e.g., mounted) extends at least partially within the opening of the optic assembly 104 (e.g., via the locking member 122) towards the recess R of the optic 120. Accordingly, the light source assembly 106 can emit light toward the recess R of the optic 120, and the optic 120 may freely move and pivot about the light source assembly 106 and the heat sink 108.

As shown in FIG. 7, the light source assembly 106 and the heat sink 108 may be stationary relative to the housing member 102, while the optic 120 may freely move and pivot about the light source assembly 106 and the heat sink 108. When the optic assembly 104 is pivoted from a first position (e.g., a non-pivoted position) to the pivoted position, the exterior surface of the holding member 118 slidably engages with the cavity of the housing member 102. Similarly, the exterior surface of the upper portion of the holding member 118 slidably engages with the friction member 110. The elastic member 111 presses the friction member 110 towards the holding member 118 of the optic assembly 104, and thus, maintains (or holds) the pivoted position of the holding member 118 (including the optic 120) against movement by gravity. According to an example embodiment, the optic assembly 104 may be pressed toward the friction member 110 during the adjustable movement of the optic 120, and the elastic member 111 may apply an opposite force on the friction member 110 to press the optic assembly 104 into the cavity of the housing member 102 to hold the desired position. In some embodiments, at least one of the outer surface of the holding member 118 and the surface of the cavity of the housing member 102 may include a friction member or layer, so that engaging surfaces can be further restricted from movement.

In various embodiments, the light source assembly 106 extends at least partially within the opening of the optic assembly 104 (e.g., the locking member 122) toward the recess R of the optic 120 in each of the first position (e.g., the non-pivoted position) and the pivoted position of the optic 120, and the light source assembly 106 and the heat sink 108 may be stationary relative to the housing member 102, such that the optic 120 can freely move and pivot about the light source assembly 106 and the heat sink 108. For example, in some embodiments, the heat sink 108 may hold the light source assembly 106 at a position in which at least a portion of the light source assembly 106 remains within the recess of the optic 120 throughout the full range of adjustable movement (e.g., pivot and/or rotation). In another example, in some embodiments, the heat sink 108 may hold the light source assembly 106 at a position in which the light source assembly 106 is held just outside of the recess R, such that a portion of the light source assembly 106 and/or the heat sink 108 is received in the recess R throughout some, but not all, of the full range of adjustable movement (e.g., pivot and/or rotation). In yet another example, in some embodiments, the heat sink 107 may hold the light source assembly 106 at a position within the opening of the optic assembly 104 (e.g., the locking member 122), but outside of the recess R, such that no portion of the light source assembly 106 and/or the heat sink 108 is received in the recess R throughout the full range of adjustable movement (e.g., pivot and/or rotation).

Figure 8:
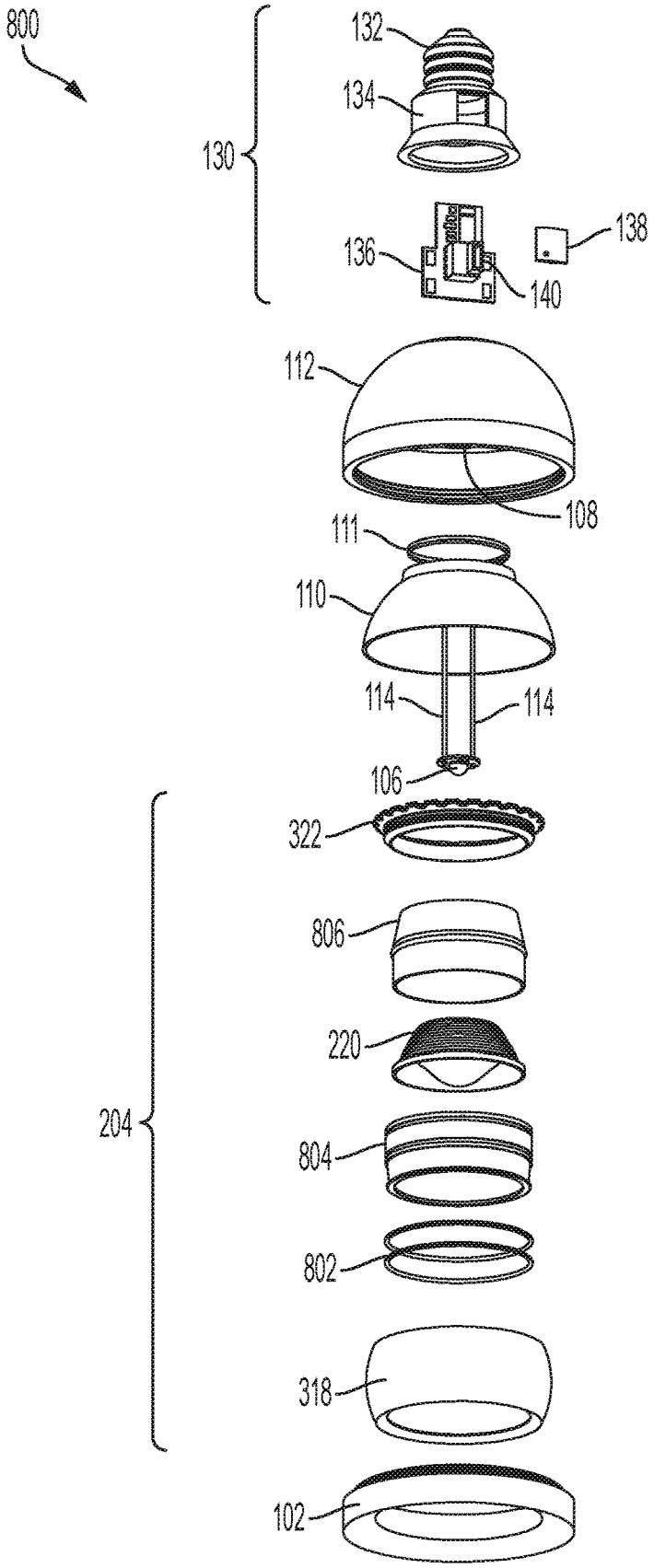
FIG. 8 is an exploded view of an adjustable lighting device assembly, according to another example embodiment.

FIG. 8 is an exploded view of an adjustable lighting device assembly, according to another embodiment of the present invention. Referring to FIG. 8, the lighting device assembly 800 may be similar to or the same as the lighting device assembly 100 shown in FIG. 1. For example, the lighting device assembly 800 may include the housing member 102, an optic assembly 204, the top member 112, and the connector assembly 130. Accordingly, the lighting device 800 may be similar or substantially similar to each of the lighting device assemblies 200, 300, 400, and 500 shown in FIGS. 2-5, respectively, except the structure, size, and/or shape of some of the components (e.g., the optic assembly 204, the holding member 318, the optic 220, the locking member 322, and/or the like) may be variously modified, while some other components may be added or omitted (e.g., the friction member 110, the elastic member 111, and/or the like). Thus, the features or aspects described herein with reference to one or more of the various embodiments of the adjustable lighting device assemblies shown in FIGS. 1-5 and 8 should typically be considered as available for other similar features or aspects described with reference to other ones of the various embodiments of the adjustable lighting device assemblies shown in FIGS. 1-5 and 8.

For example, as shown in FIG. 8, the lighting device assembly 800 may include many of the same or similar components as those of the lighting device assembly 200 shown in FIG. 2. For example, the lighting device assembly 800 may include the housing member 102, the light source assembly 106, the friction member 110, the elastic member 111, the top member 112 including the heatsink 108, and the connector assembly 130, which are all the same or substantially the same as those of the lighting device assembly 200 shown in FIG. 2. Accordingly, these components may be variously modified or omitted, for example, such as those like or similar components described with reference to the lighting device assemblies 200, 300, 400, and 500 described with reference to FIGS. 2-5 herein.

Further, like the optic assemblies 104 described with reference to FIGS. 2-5, the optic assembly 204 may slidably engage a cavity of the housing member 102 in a ball and socket manner. Thus, the optic assembly 204 has an outer surface having a curvature that is held within a corresponding cavity (with a corresponding mating curvature and dimension) within the housing member 102. For example, in some embodiments, the outer surface of the optic assembly 204 may have a shape of a portion of a sphere, and may be held within a corresponding sphere-shaped cavity within the housing member 102. Accordingly, the optic 220 (via the optic assembly 204) may pivot in any direction (e.g., on a 360 degree plane) within the housing member 102, by slidably engaging the cavity of the housing member 102. However, the present invention is not limited thereto, and in another embodiment, the pivoting directions of the optic 220 may be limited or reduced, for example, by providing stop surfaces or a shape of the surface of the optic assembly 204 and/or a shape of the cavity within the housing member 102, that limits movement in one or more directions.

Unlike the optic assemblies 104 described with reference to FIGS. 2-5, however, the optic assembly 204 of FIG. 8 is further configured to adjust a focus of emitted light or light beam. For example, in some embodiments, the focus of the emitted light or light beam may be adjusted by adjusting a distance of the optic 220 from the light source of the light source assembly 106. Accordingly, the optic assembly 204 may include the holding member 318, a telescoping sleeve 804, one or more friction rings 802, the optic 220, a locking sleeve 806, and a locking member 322. In some embodiments, the telescoping sleeve 804 may slidably engage an interior surface of a cavity of the holding member 318 in a telescoping manner to adjust a distance between the optic 220 and a light source of the light source assembly 106. For example, in some embodiments, the telescoping sleeve 804 may slide the optic 220 within the holding member 318 to be closer to or further away from the light source of the light source assembly 106. In other embodiments, the telescoping sleeve may engage the interior surface of the cavity of the holding member 318 in a twisting manner to adjust a distance between the optic 220 and the light source of the light source assembly 106. In some embodiments, an end of the telescoping sleeve 804 may be exposed through an opening of the housing member 102 so that a portion of the telescoping sleeve 804 can be slidably (or twistably) extended through the opening of the housing member 102. In various embodiments, each of the holding member 318, the telescoping sleeve 804, the locking sleeve 806, and the locking member 322 may be formed or include any suitable material, for example, metal, plastic, glass, ceramic, and/or the like, or any suitable composite material thereof.

In more detail, in some embodiments, the holding member 318 receives the telescoping sleeve 804, optic 220, and locking sleeve 806, and may facilitate the movement (e.g., pivot and/or rotation) of the optic 220 within the housing member 102. For example, in some embodiments, the holding member 318 may have an outer surface having a curvature corresponding to the holding members 218 shown with reference to FIGS. 4 and 5. That is, the outer surface of the holding member 318 may include a lower surface portion that slidably engages a cavity (with a corresponding mating curvature and dimension) of the housing member 102 in a ball and socket manner. Further, the outer surface of the holding member 318 may include an upper surface portion that slidably engages an internal cavity (with a corresponding mating curvature and dimension) of the friction member 110 in a ball and socket manner. In some embodiments, the interior surface of the holding member 318 may include a ledge, a lip, and/or other surface features to prevent the telescoping sleeve 804 from being slidably removed through the opening of the housing member 102.

In some embodiments, the telescoping sleeve 804 may receive the optic 220 and the locking sleeve 806 therein, and may facilitate movement (e.g., telescopic movement) of the optic 220 within the holding member 318. For example, in some embodiments, the telescoping sleeve 804 may have a cylindrical or tubular shape, and may have an outer surface that slidably engages the cavity of the holding member 318 to telescopically extend the optic 220 through an end of the holding member 318 and through the opening of the housing member 102. In some embodiments, the telescoping sleeve 804 may have a step, a protruding bezel, and/or other surface feature that engages the surface feature (e.g., the ledge or lip) of the interior surface of the holding member 318 to prevent the telescoping sleeve 804 from being slidably removed through the opening of the housing member 102.

In some embodiments, the exterior surface of the telescoping sleeve 804 may include one or more grooves or channels to receive one or more of the friction rings 802. For example, in some embodiments, the friction rings 802 may provide a frictional force (or a friction surface) between the interior surface of the holding member 318 and the exterior surface of the telescoping sleeve 804 to prevent or substantially prevent the telescoping sleeve 804 from sliding to a different position from a desired position due to gravity (e.g., without manual force). Preferably, the frictional force may be overcome by manual force applied to manually slide (e.g., telescopically) the optic 220 and the telescoping sleeve 804 relative to the holding member 318. Accordingly, in some embodiments the friction rings 802 may have a ring shape (e.g., an o-ring shape), and may be received in the one or more grooves or channels formed around the exterior surface of the telescoping sleeve 804. In various embodiments, the friction rings 802 may include any suitable material to provide the friction surface, for example, but not limited to, silicone, rubber, and/or the like. However, the present invention is not limited thereto, and in some embodiments, the friction rings 802 may be omitted. In this case, an interior surface of the cavity of the holding member 318 and/or an exterior surface of the telescoping sleeve 804 may include a friction surface as described above or one or more friction strips (strips of rubber or other material that enhances frictional contact), to maintain a desired position of the telescoping sleeve 804 (and the optic 220) within the holding member 318.

Other embodiments may include other suitable features for adjusting a distance of the optic 220 from the light source of the light source assembly 106. For example, in other embodiments, instead of (or in addition to) the friction rings 802, each of engaging surfaces of the holding member 318 (e.g., the interior surface) and the telescoping sleeve 804 (e.g., the exterior surface) may include one or more engagement members (e.g., rails, protrusions, grooves, treading, or the like) that engage each other to enable selective adjustment of the distance between the optic 220 and the light source of the light source assembly 106. In some embodiments, the engagement members may provide for adjustments at pre-defined increments, or may provide continuous control for fine-tuned adjustments.

Figure 13A:
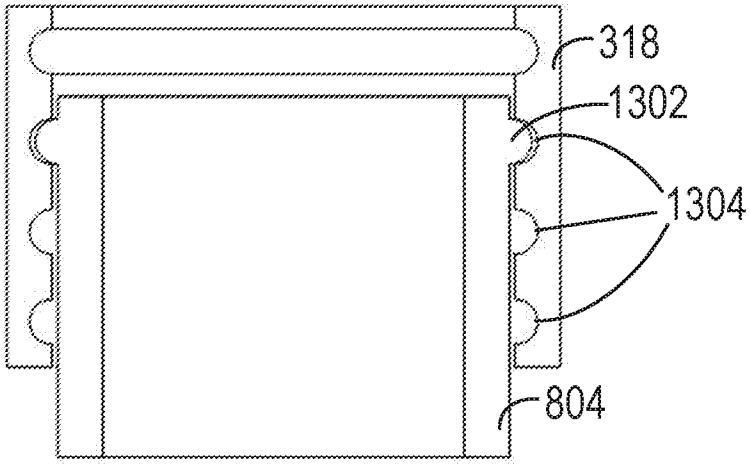
FIGS. 13A and 13B show an enlarged view of the engaging surfaces of the holding member and the telescoping sleeve, according to various embodiments.
Figure 13B:
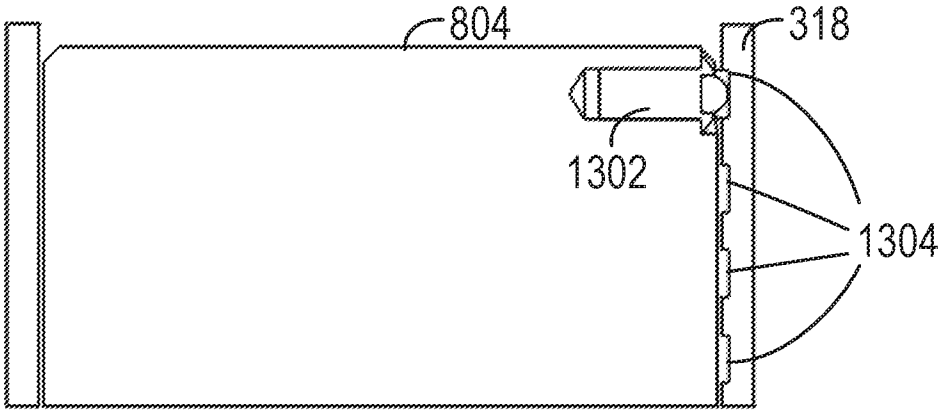

For example, FIGS. 13A and 13B show an enlarged view of the engaging surfaces of the holding member 318 and the telescoping sleeve 804, according to various embodiments. For convenience of illustration, only portions of each of the holding member 318 and the telescoping sleeve 804 are shown in FIGS. 13A and 13B, but it should be appreciated that each of the holding member 318 and the telescoping sleeve 804 may have any suitable structure or configuration described herein with reference to FIGS. 1-8. As shown in FIGS. 13A and 13B, in some embodiments, instead of the friction rings 802 (or in addition to the friction rings 802), each of the engaging surfaces of the telescoping sleeve 804 and the holding member 318 may include one or more engaging members 1302 and 1304. For example, in some embodiments, the exterior surface of the telescoping sleeve 804 may include one or more protrusions 1302 to engage one or more grooves 1304 formed in the interior surface of the holding member 318. In other embodiments, the interior surface of the holding member 318 may include one or more protrusions to engage one or more grooves formed in the exterior surface of the telescoping sleeve 804. Accordingly, in some embodiments, the one or more protrusions 1302 may slidably engage the one or more grooves 1304 to adjust a distance between the optic 220 and a light source of the light source assembly 106 at predefined increments dictated by the placement of the grooves 1304.

For example, in some embodiments, the one or more protrusions 1302 may provide a frictional force between the interior surface of the holding member 318 and the exterior surface of the telescoping sleeve 804 with stop locations dictated by the placement of the grooves 1304 to prevent or substantially prevent the telescoping sleeve 804 from sliding to a different position from a desired position due to gravity (e.g., without manual force). Preferably, the frictional force may be overcome by manual force applied to manually slide (e.g., telescopically) the optic 220 and the telescoping sleeve 804 relative to the holding member 318 to a next stop location (e.g., a next groove). In some embodiments, the one or more protrusions may be integrally formed (e.g., cast, molded, extruded, or the like) with the telescoping sleeve 804 (or the holding member 318) or may be separately formed and arranged on the telescoping sleeve 804 (or the holding member 318). For example, in some embodiments, as shown in FIG. 13A, the protrusion 1302 may be integrally formed with the telescoping sleeve 804. In this case, the protrusion 1302 may be made of the same material as that of the telescoping sleeve 804, or may be made from a different material. In another example, in some embodiments, as shown in FIG. 13B, the protrusion 1302 may be separately formed and then arranged on the telescoping sleeve 804. For example, as shown in FIG. 13B, in some embodiments, the protrusion 1302 may be a ball plunger having a spring loaded bearing that engages the surface of the holding member 318 and the grooves 1304. However, the present invention is not limited thereto, and in other embodiments, the protrusion 1302 may include any device or flexible material that can be compressed and expanded to engage the surface and grooves of the holding member 318 (or the telescoping sleeve 804), such as a plastic, rubber, or metallic spring, clip, clasp, catch, pin, or the like.

In another example, the telescoping sleeve 804 may engage the interior surface of the cavity of the holding member 318 in a twisting manner to adjust a distance between the optic 220 and the light source of the light source assembly 106. For example, in another embodiment, the engagement members 1302 and 1304 of the engaging surfaces may be (or include) threading members, such that the outer surface of the telescoping sleeve includes threading that mates with corresponding threading on the interior surface of the cavity of the holding member 318. In some embodiments, the treading provides enhanced control for a rate of adjustment of the telescoping sleeve, such that the distance between the optic 220 and the light source of the light source assembly 106 can be adjusted incrementally simply by twisting the telescoping sleeve 804 within the holding member 318. In some embodiments, the rate of adjustment can be further refined by adjusting the pitch (or slope) of the treading on the outer surface of the telescoping sleeve and the corresponding threading on the interior surface of the cavity of the holding member 318. However, the present disclosure is not limited thereto, and in other embodiments, the threading members may be embodied as rails, or one of the outer surface of the telescoping sleeve 804 and the interior surface of the holding member 318 includes a protruding member that engages the threading (or railing) member of the other.

In some embodiments, the locking sleeve 806 may lock the optic 220 at a desired position within the telescoping sleeve 804. For example, in some embodiments, the locking sleeve 806 may have a cylindrical or tubular shape, and may lock (e.g., twist-lock, snap-lock, or the like) the optic 220 at a suitable position within the telescoping sleeve 804. In some embodiments, the locking sleeve 806 may control an amount of pivoting angle of the holding member 318 relative to the housing member 102 depending on the extended state of the telescoping sleeve 804. For example, in some embodiments, the locking sleeve 806 may restrict the amount of pivoting angle of the holding member 318 relative to the housing member 102 by contacting various points along the surface of the heat sink 108 depending on the extended state of the telescoping sleeve 804. For example, in some embodiments, the locking sleeve 806 may have a first end to receive at least a portion of the optic 220, and a second end opposite the first end to receive the heatsink 108 extended therethrough. In some embodiments, an opening at the second end may be narrower than an opening at the first end. For example, in some embodiments, the locking sleeve 806 may have an internal surface that slopes downward (e.g., towards the first end) and outward (e.g., towards the telescoping sleeve 804), such that a circumference of the opening increases from the second end towards the first end of the locking sleeve 806. In this case, as will be described in more detail with reference to FIGS. 9-10, in some embodiments, the second end of the locking sleeve 806 may control the pivoting angle of the holding member 318 relative to the housing member 102 by contacting various points along the length of the heat sink 108 depending on the extended state of the telescoping sleeve 804. However, the present disclosure is not limited thereto, and in other embodiments, the locking sleeve 806 may be omitted and/or variously modified (e.g., the slope of the internal surface may be omitted).

In some embodiments, the locking member 322 may lock the telescoping sleeve 804 and the optic 220 to the holding member 318. For example, still referring to FIG. 8, in some embodiments, the locking member 322 may have an upper portion and a lower portion. The lower portion of the locking member 322 may have a tubular (or ring) shape that extends from the upper portion toward the holding member 318 to mate with the holding member 318. For example, the lower portion of the locking member 322 may lock (e.g., twist-lock) onto the holding member 318 to contain the telescoping sleeve 804, the optic 220, and the locking sleeve 806 within the holding member 318. In various embodiments, the locking member 322 may include an opening through which the light source assembly 106 and/or the heat sink 108 is received to enable pivoting or rotation of the optic 220 about the light source assembly 106 and/or the heat sink 108. In some embodiments, the locking member 322 may prevent the telescoping sleeve 804 from extending into the cavity of the friction member 110. However, in other embodiments, the locking member 322 may be omitted. For example, in other embodiments, the telescoping sleeve 804 may have a movement limiting surface feature (e.g., lip, protrusion, or other feature) that prevents the telescoping sleeve 804 from extending into the cavity of the friction member 110, and in this case, the locking member 322 may be omitted.

In some embodiments, the optic 220 may be the same as or similar to the optic 120 shown in FIG. 6. For example, in some embodiments, the optic 220 may include a recess R and an emitting surface E. In some embodiments, the optic 220 includes a sidewall 602 having a top edge 604 that defines the recess R, and the recess R of the optic 220 may have a depth d and a diameter (or width) w. However, compared to the optic 120 shown in FIG. 6, the shape of the optic 220 may be variously modified, for example, to have a plurality of focal points for the light source of the light source assembly 106. For example, in some embodiments, the optic 220 may have a first focal point that is located outside of the recess R, and a second focal point that is located within the depth d of the recess R. In this case, for example, when the optic 220 is at a first telescopic position (e.g., via the telescoping sleeve 804 at an extended position), the light source of the light source assembly 106 may be located within the first focal point of the optic 220, and when the optic 220 is at a second telescopic position (e.g., via the telescoping sleeve 804 at a compressed position), the light source of the light source assembly 106 may be located within the second focal point of the optic 220. Accordingly, in some embodiments, the emitting surface E of the optic 220 may include a dome shape to focus (or unfocus) light according to the distance of the light source (e.g., via the telescoping sleeve 804) to the optic 220.

In other embodiments, the optic assemblies 104 shown in FIGS. 3-5 may be replaced with the optic assembly 204 shown in FIG. 8, such that the embodiments shown with reference to FIGS. 3-5 may further include the optic assembly 204 configured to adjust a focus of emitted light or light beam. In still other embodiments, the connector assembly 130 may be omitted, such that a top of the top member 112 or a top of the heatsink 108 directly contacts a surface of a fixture or housing on which the lighting device is mounted. In yet other embodiments, any of the adjustable optic assemblies shown and described in U.S. application Ser. Nos. 15/828,234, 16/175,470, and 16/226,526, which are incorporated by reference in their entirety herein, may be replaced with the optic assembly 204 shown in FIG. 8. As a non-limiting example, referring again to FIG. 5, in some embodiments, the connector assembly 130 may be omitted, such that a top of the heatsink 108 is exposed through an opening of the top member 112 to directly contact a surface of a fixture or housing on which the lighting device 500 is mounted. Also, the optic assembly 104 may be replaced with the optic assembly 204 shown in FIG. 8, and the housing member 102 may have more of a cylindrical shape than that shown in FIG. 5. Other embodiments may have other suitable shapes and components, without departing from the spirit of the present disclosure.

Figure 9B:
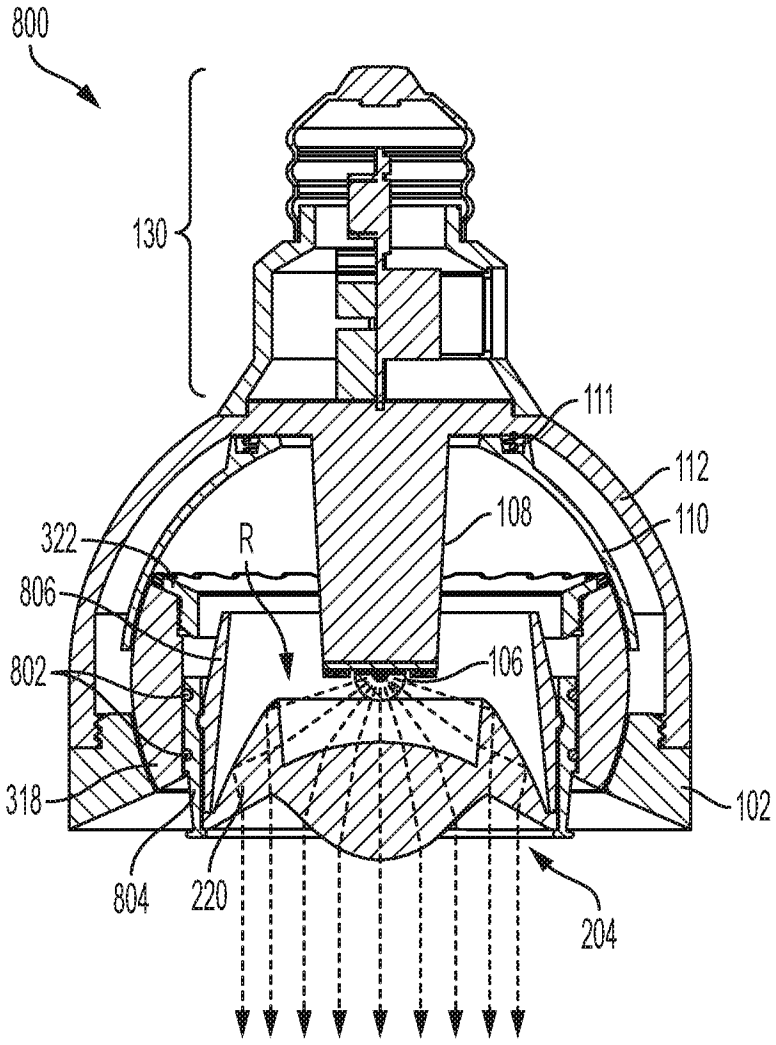
FIG. 9B is a cross-sectional view of the lighting device shown in FIG. 8 with the optic in the first position and in an extended state, according to an embodiment.
Figure 9A:
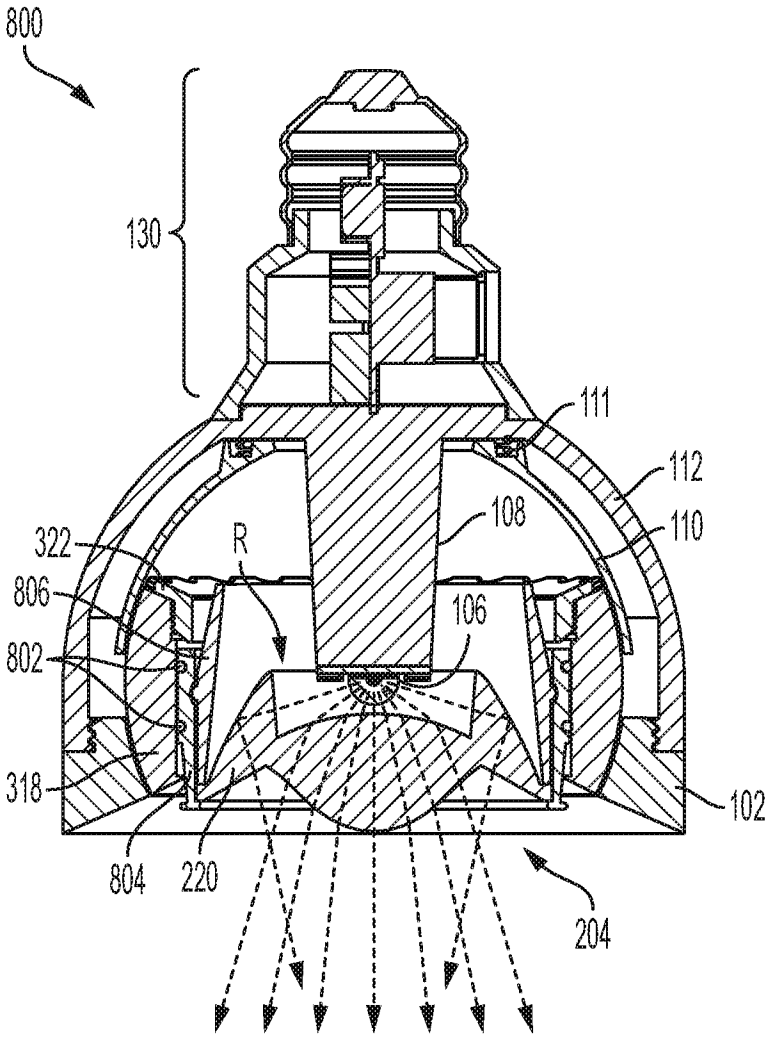
FIG. 9A is a cross-sectional view of the lighting device shown in FIG. 8 with the optic in a first position and in a compressed state, according to an example embodiment.
Figure 10B:
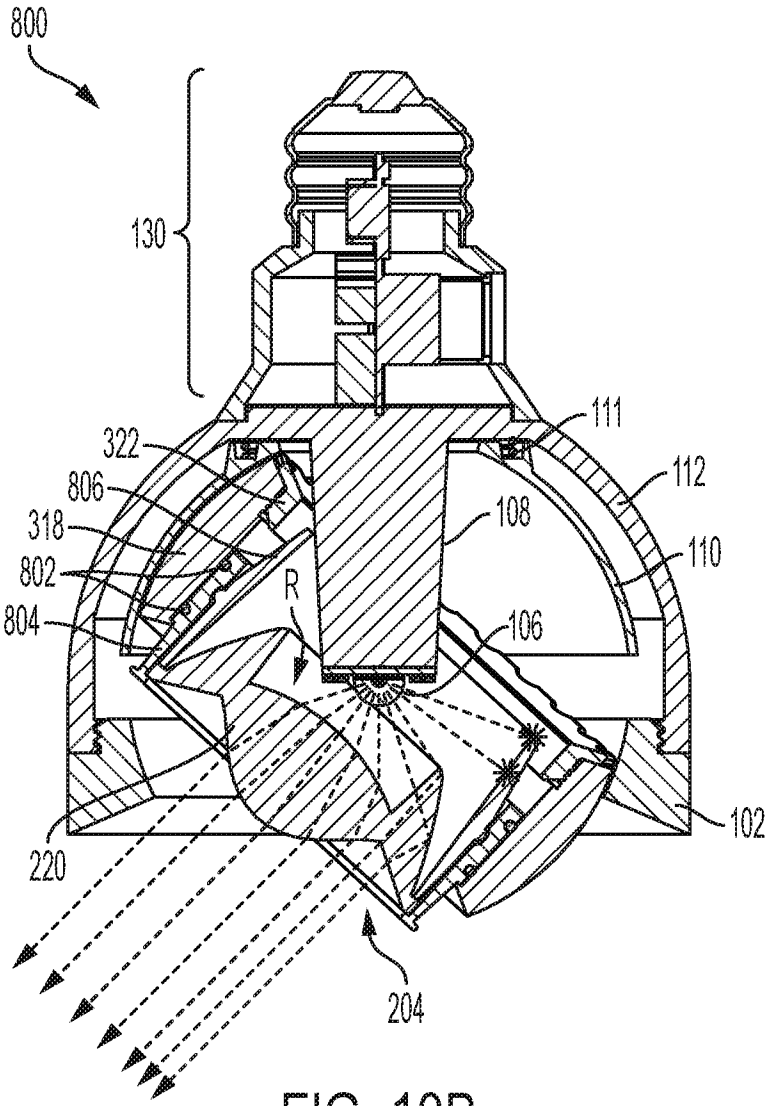
FIGS. 10A-10B are cross-sectional views of the lighting devices shown in FIGS. 9A and 9B, respectively, with the optic in a second position, according to example embodiments.
Figure 10A:
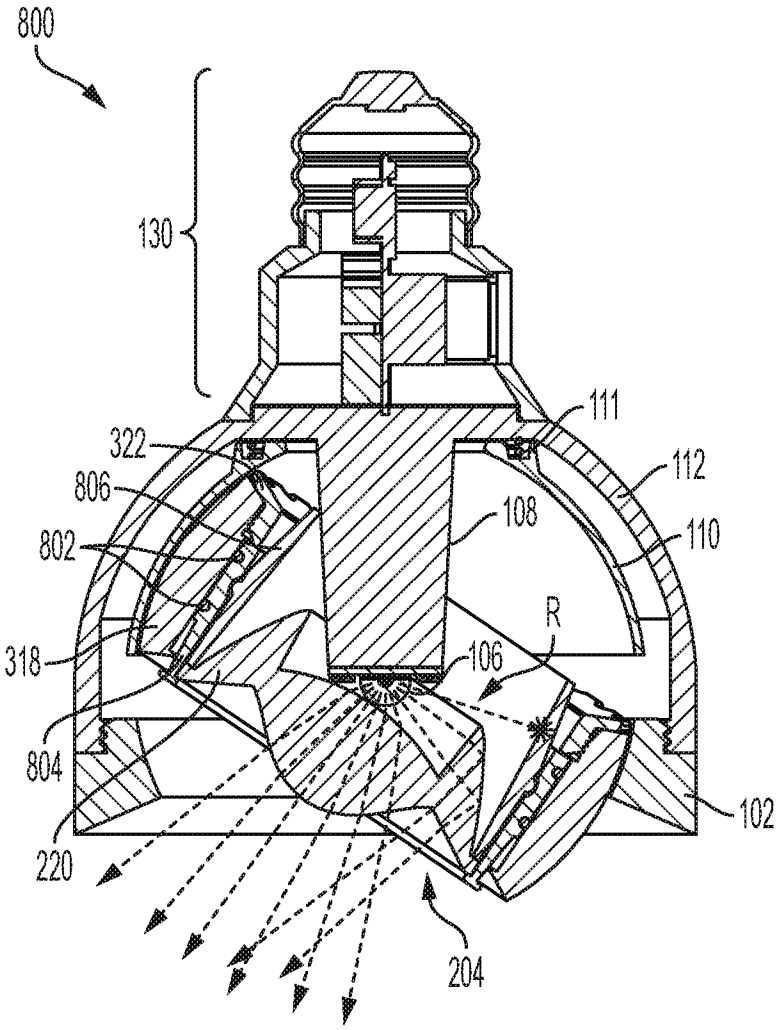

FIG. 9A is a cross-sectional view of the lighting device 800 shown in FIG. 8 with the optic in a first position and in a compressed state, according to an embodiment, and FIG. 9B is a cross-sectional view of the lighting device 800 with the optic in the first position and in an extended state, according to an embodiment. FIG. 10A is a cross-sectional view of the lighting device 800 shown in FIG. 9A with the optic in a second position and in the compressed state, according to an embodiment, and FIG. 10B is a cross-sectional view of the lighting device 800 shown in FIG. 9B with the optic in the second position and in the extended state, according to an embodiment. Referring to FIGS. 8, 9A, 9B, 10A, and 10B, the lighting device assembly 800 includes the housing member 102, the optic assembly 204 held in the cavity of the housing member 102, the light source assembly 106, the heat sink 108, the friction member 110, the elastic member 111, and the top member 112. The heat sink 108 and the top member 112 is unitarily formed (e.g., cast), and the connector assembly 130 is mounted to the top member 112. The light source assembly 106 is attached (e.g., mounted) at an end of the heat sink 108, such that the heat sink 108 transfers heat from the light source assembly 106 to the housing member 102 through the top member 112. The end of the heat sink 108 on which the light source assembly 106 is attached (e.g., mounted) extends at least partially within the opening of the locking member 322 towards the recess of the optic 220. Accordingly, the light source assembly 106 can emit light towards the recess R of the optic 220, and the optic 220 may freely move and pivot about the light source assembly 106 and the heat sink 108.

The optic assembly 204 includes the holding member 318, the telescoping sleeve 804, the friction rings 802, the optic 220, the locking sleeve 806, and the locking member 322. The telescoping sleeve 804 slidably engages the interior surface of the cavity of the holding member 318 in a telescoping manner to adjust a distance between the optic 220 and the light source of the light source assembly 106. For example, as shown in FIG. 9A, when the telescoping sleeve 804 is in a compressed state, the telescoping sleeve 804 holds the optic 220 in a first telescopic position, such that the light source of the light source assembly 106 is received at a first focal point of the optic 220. For example, in some embodiments, when the telescoping sleeve 804 is in the compressed state, the light source of the light source assembly is received at the first focal point within the depth d of the recess R of the optic 220, such that light emitted by the light source is transmitted through the optic 220 at a wider angle. On the other hand, as shown in FIG. 9B, when the telescoping sleeve 804 is in an extended state, the telescoping sleeve 805 holds the optic 220 in a second telescopic position, such that the light source of the light source assembly 106 is received at a second focal point of the optic 220. For example, in some embodiments, when the telescoping sleeve 804 is in the extended state, the light source of the light source assembly is received at the second focal point outside the recess R of the optic 220, such that the light emitted by the light source is transmitted through the optic 220 at a more focused (e.g., narrower) angle. Accordingly, in some embodiments, the optic assembly 204 may control a focus of the emitted light or light beam by telescopically adjusting a distance between the optic 220 and the light source of the light source assembly 106.

As shown in FIGS. 10A and 10B, in some embodiments, the light source assembly 106 and the heat sink 108 may be stationary relative to the housing member 102, while the optic 220 may freely move and pivot about the light source assembly 106 and the heat sink 108 via the optic assembly 204. When the optic assembly 204 is pivoted from the first position to the second position, the exterior surface of the holding member 318 slidably engages with the cavity of the housing member 102. Similarly, the exterior surface of the holding member 318 slidably engages the cavity of the friction member 110. In this case, the elastic member 111 presses the friction member 110 towards the optic assembly 204, thereby pressing the optic assembly 204 towards the cavity of the housing member 102. Thus, the pivoted position of the optic 220 may be maintained against movement by gravity. For example, in some embodiments, the optic assembly 204 may be pressed toward the friction member 110 during the adjustable movement of the optic 120, and the elastic member 111 may apply an opposite force on the friction member 110 to press the optic assembly 204 into the cavity of the housing member 102 to hold the desired position.

In some embodiments, a pivoting angle of the optic assembly 204 may be controlled depending on the telescopic position of the optic 220 relative to the light source of the light source assembly 106. For example, in some embodiments, the optic assembly 204 may include the locking sleeve 806 to limit the pivoting angle of the optic assembly 204 by contacting a side of the heat sink 108 when a maximum pivoting angle is reached. In some embodiments, the heat sink 108 may have various widths (or circumferences) along the length of the heat sink 108, and as the telescoping sleeve 804 is extended, the locking sleeve 806 may contact various different widths of the heat sink 108, thereby changing an amount of the maximum pivoting angle depending on the extended position of the telescoping sleeve 804. For example, referring to FIG. 10A, when the telescoping sleeve 804 is in a compressed state, the amount of maximum pivoting angle is reduced by the increased width of the heat sink 108. Thus, as the optic assembly 204 is pivoted, the locking sleeve 806 contacts the sidewall of the heat sink 108 at a reduced angle of pivot of the optic assembly 204, thereby reducing the amount of maximum pivoting angle of the optic assembly 204. On the other hand, referring to FIG. 10B, when the telescoping sleeve 805 is in an extended state, the amount of maximum pivoting angle is increased by the decreased width of the heat sink 108. Thus, as the optic assembly 204 is pivoted, the locking sleeve 806 contacts the sidewall of the heat sink 108 at an increased angle of pivot of the optic assembly 204, thereby increasing the amount of maximum pivoting angle of the optic assembly 204. However, the present disclosure is not limited thereto, and in other embodiments, the locking sleeve 806 may be omitted or variously modified such that the locking sleeve 806 does not limit the maximum pivoting angle amount of the optic assembly 204.

Figure 11:
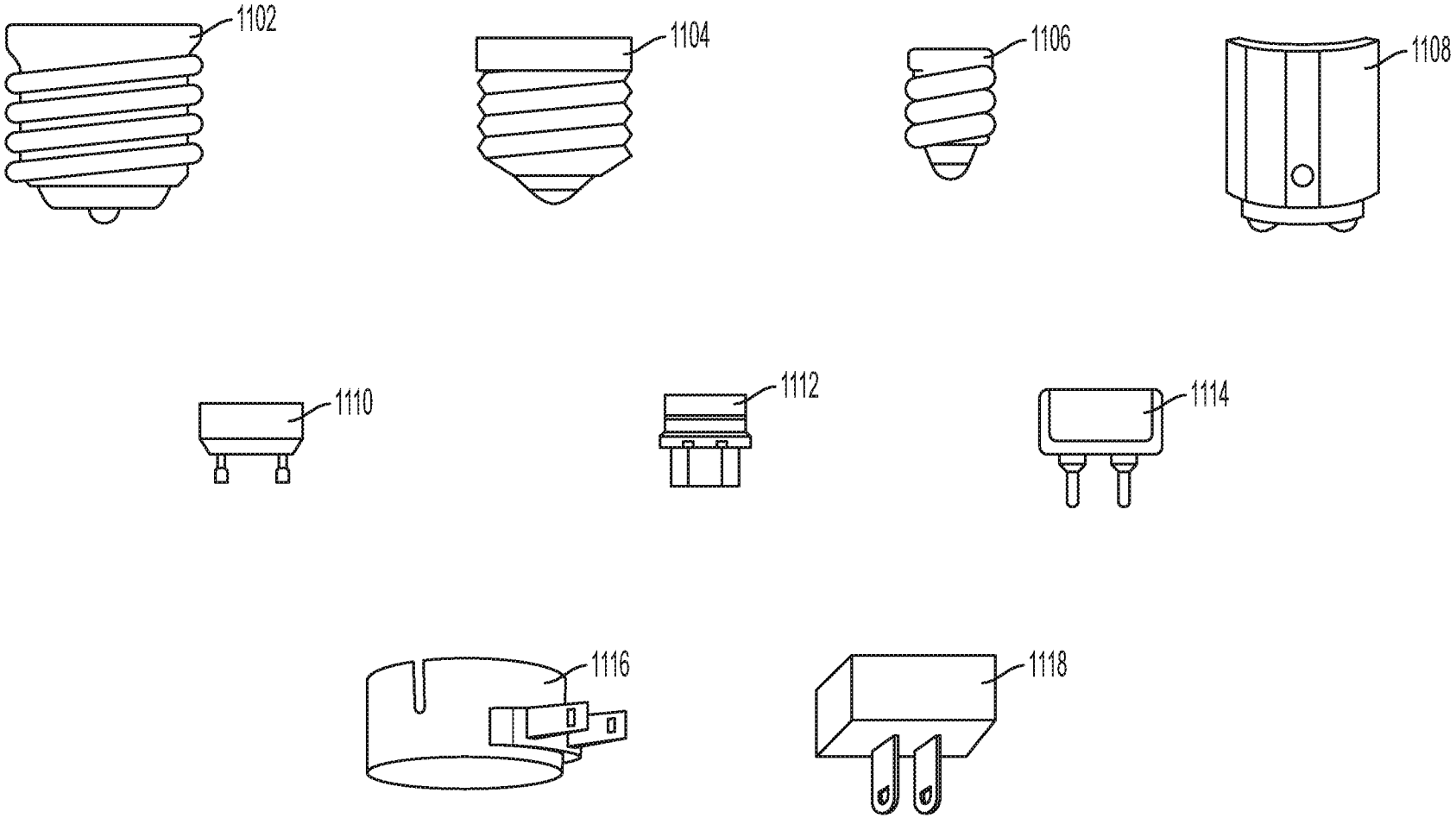
FIG. 11 shows various different example connectors of the connector assembly, according to various example embodiments.

FIG. 11 shows various different example connectors of the connector assembly, according to various embodiments. In various embodiments, the lighting devices 100, 200, 300, 400, 500, and 800 may be used with any standard or proprietary light socket without requiring complex installation or additional mounting hardware (e.g., mounting brackets, housing fixtures, and/or the like). For example, in various embodiments, the connector 132 of the connector assembly 130 may include any suitable screw type base connector, for example, such as a Mogul base connector 1102, Medium base connector 1104, Candelabra base connector 1106, Miniature Screw, Miniature Candelabra, European, Intermediate, Medium Skirted, European Medium, or the like. In various embodiments, the connector 132 of the connector assembly 130 may include any suitable Bayonet type base connector, for example, such as a Double Contact Bayonet 1108, Miniature Bayonet, Single Contact Bayonet, Double Contact Bayonet Medium, Index Double Contact Bayonet, or the like. In various embodiments, the connector 132 of the connector assembly 130 may include any suitable Twist & Lock type base connector 1110, for example, such as a GX8.5, GU10, GX10, GU24, or the like. In various embodiments, the connector 132 of the connector assembly 130 may include any suitable wedge type base connector 1112, pin and BI pin base type base connector 1114, Side Prong type base connector 1116, End Prong type base connector 1118, or the like. However, the present disclosure is not limited to the types of base connectors shown in FIG. 11, and other suitable types of base connectors are contemplated.

Figure 12:
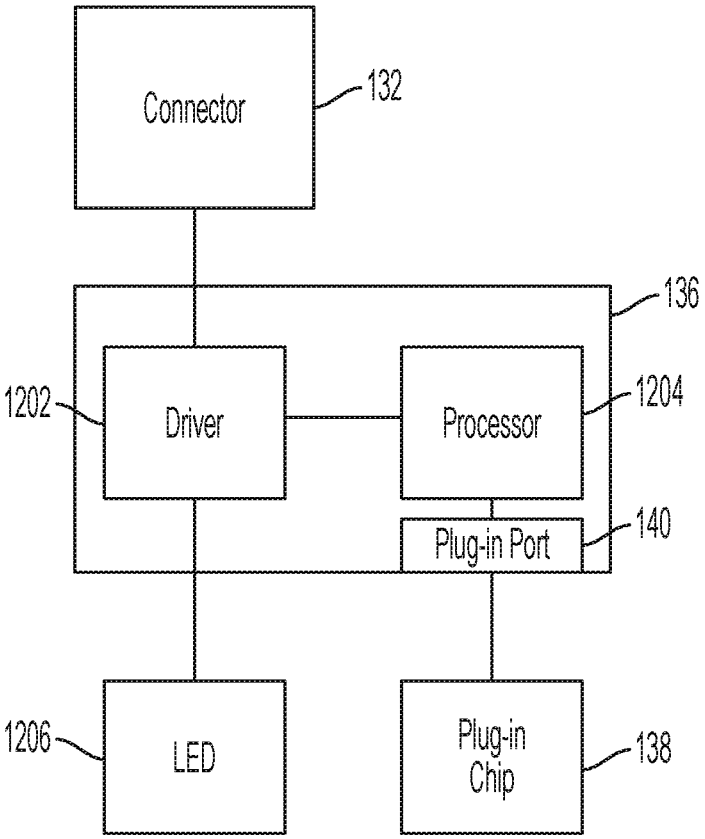
FIG. 12 shows a block diagram of an example of a driver and electronics circuit, according to some example embodiments.

FIG. 12 is a block diagram of an example of a driver and electronics circuit 136, according to some example embodiments. In various embodiments, the driver and electronic circuits 136 shown in FIGS. 2-5 and 8 may be the same as or similar to the driver and electronics circuit 136 shown in FIG. 12. Referring to FIG. 12, in various embodiments, the driver and electronics circuit 136 may include one or more drivers 1202, one or more processors 1204, and one or more plug-in ports 140 that are communicably connected to the one or more processors 1204. In some embodiments, the one or more drivers 1202 may be electrically connected to the connector 132 of the connector assembly 130 to receive power from a power source via the connector 132. In some embodiments, the one or more drivers 1202 may include one or more power supplies to convert power provided from the power source via the connector 132 to a suitable power for driving a light source 1206. For example, in various embodiments, the light source 1206 may be the light source of the light source assembly 106 as shown in FIGS. 2-5 and 7-11. In a non-limiting example, the light source 1206 may be an LED light source. In this case, the one or more drivers 1202 may include an LED driver to convert the power from the power source to a low-voltage power suitable to drive the LED light source 1206. However, the present disclosure is not limited thereto, and in other embodiments, the LED light source 1206 may include any suitable types of light sources, for example, such as incandescent, halogen, fluorescent, combinations thereof, and/or the like. In this case, the one or more drivers 1202 may include one or more suitable types of power supplies corresponding to the type of light source 1206.

In some embodiments, the one or more processors 1204 execute instructions stored on memory (e.g., non-transient computer readable media) to process data and/or to control various functions of the lighting device (e.g., temperature, light output, color of light, direction of light, focus of light, and/or the like). In some embodiments, the one or more processors 1204 may be implemented by one or more programmable processors to execute one or more executable instructions, such as a computer program, to perform the functions described herein. In various embodiments, the one or more processors 1204 may include, for example, one or more application specific integrated circuits (ASICs), microprocessors, digital signal processors (DSPs), graphics processing units (GPUs), microcontrollers, field programmable gate arrays (FPGAs), programmable logic arrays (PLAs), multi-core processors, general-purpose computers with associated memory, or the like.

In some embodiments, the one or more processors 1204 may be communicably connected to the plug-in port 140 to receive the optional plug-in chip 138 (or to connect to a computing device). As discussed in more detail above, in various embodiments, the optional plug-in chip may include non-transient computer readable media to provide instructions to operate the processor (or certain functions thereof), or may include a device or component that adds wireless data communications functionality to the processor of the driver and electronics circuit 136. In various embodiments, the plug-in port 140 may include any suitable type of port corresponding to the optional plug-in chip 138 (or other device, such as a computing device). As discussed herein, in various embodiments, the optional plug-in chip 138 (or other device) may program, re-program, or provide additional functionalities (e.g., data communications functionalities) to the one or more processors 1204 to add smart capabilities or IoT capabilities to the adjustable lighting device according to various embodiments of the present disclosure.

The foregoing description of illustrative embodiments has been presented for purposes of illustration and of description. It is not intended to be exhaustive or limiting, and modifications and variations may be possible in light of the above teachings or may be acquired from practice of the disclosed embodiments. Various modifications and changes that come within the meaning and range of equivalency of the claims are intended to be within the scope of the invention. Thus, while certain embodiments of the present invention have been illustrated and described, it is understood by those of ordinary skill in the art that certain modifications and changes can be made to the described embodiments without departing from the spirit and scope of the present invention as defined by the following claims, and equivalents thereof.

What is claimed is:

1. A lighting device assembly comprising:

a heat sink;

a light source attached to one end of the heat sink;

an optic assembly configured to pivot an optic about the light source; and a housing member having a cavity in which at least a portion of the optic assembly is received, wherein the optic is configured to be telescopically adjusted within the optic assembly to adjust a focal point between the light source and the optic; and wherein the optic assembly comprises a holding member configured to receive the optic, the holding member having a curved outer surface configured to slidably engage a curved surface of the cavity of the housing member to pivot the optic about the light source.

2. The lighting device assembly of claim 1, wherein the optic assembly further comprises a telescoping sleeve configured to hold the optic within the holding member, the telescoping sleeve configured to slidably engage an interior surface of the holding member to telescopically adjust the optic within the holding member.

3. The lighting device assembly of claim 2, wherein an end of the telescoping sleeve is configured to extend through an opening of the housing member to telescopically adjust the optic.

4. The lighting device assembly of claim 1, wherein the optic comprises a plurality of focal points, and the optic is configured to be telescopically moved to position the light source at different ones of the focal points to change a focus of emitted light.

5. The lighting device assembly of claim 4, wherein the optic comprises a first focal point within a recess of the optic, and a second focal point outside of the recess of the optic.

6. The lighting device assembly of claim 5, wherein the light source is received at the first focal point when the optic is in a compressed telescopic position, and the light source is received at the second focal point when the optic is in an extended telescopic position.

7. A lighting device assembly comprising:
a heat sink;
a light source attached to one end of the heat sink;
an optic assembly configured to pivot an optic about the light source; and
a housing member having a cavity in which at least a portion of the optic assembly is received,
wherein the optic is configured to be telescopically adjusted within the optic assembly to adjust a focal point between the light source and the optic; and
wherein a maximum pivoting angle of the optic about the light source is changed depending on a telescopic position of the optic.

8. The lighting device assembly of claim 7, wherein a first maximum pivoting angle of the optic corresponding to when the optic is in a compressed telescopic position is less than a second maximum pivoting angle of the optic corresponding to when the optic is in an extended telescopic position.

9. The lighting device assembly of claim 1, further comprising:
a top member configured to enclose the housing member; and
a base connector mounted directly on the top member, the base connector configured to mate with a lamp socket to drive the lighting device assembly.

10. A lighting device assembly comprising:
a heat sink;
a light source attached to one end of the heat sink;
an optic assembly configured to pivot an optic about the light source;
a housing member having a cavity in which at least a portion of the optic assembly is received;
a top member configured to enclose the housing member; and
a base connector attached to the top member, the base connector having a cavity to house a driver and electronic circuit to drive the light source;
wherein the optic is configured to be telescopically adjusted within the optic assembly to adjust a focal point between the light source and the optic.

11. A lighting device assembly comprising:
a heat sink;
a light source attached to one end of the heat sink;
an optic assembly configured to pivot an optic about the light source;
a housing member having a cavity in which at least a portion of the optic assembly is received;
a top member configured to enclose the housing member; and
a base connector attached to the top member, the base connector having a cavity to house a driver and electronic circuit to drive the light source;
wherein the base connector has an opening to connect the driver and electronic circuit to the light source, and the top member is configured to cover the opening when the base connector is attached to the top member.

12. A lighting device assembly comprising:
a heat sink;
a light source attached to one end of the heat sink;
an optic assembly configured to pivot an optic about the light source;
a housing member having a cavity in which at least a portion of the optic assembly is received;
a top member configured to enclose the housing member; and
a base connector attached to the top member, the base connector having a cavity to house a driver and electronic circuit to drive the light source;
wherein the base connector is spaced from the top member via a wire assembly that connects the driver and electronic circuit to the light source.

13. A lighting device assembly comprising:
a heat sink;
a light source attached to one end of the heat sink;
an optic assembly configured to pivot an optic about the light source;
a housing member having a cavity in which at least a portion of the optic assembly is received;
a top member configured to enclose the housing member; and
a base connector attached to the top member, the base connector having a cavity to house a driver and electronic circuit to drive the light source;
wherein the driver and electronic circuit includes a plug-in port, and the base connector is configured to expose the plug-in port.

14. The lighting device assembly of claim 13, wherein the plug-in port is configured to receive a plug-in chip, and the plug-in chip is configured to add data communications functionality to the lighting device assembly.

15. A lighting device assembly comprising:
a heat sink;
a light source attached to one end of the heat sink;
an optic assembly configured to pivot an optic about the light source;
a housing member having a cavity in which at least a portion of the optic assembly is received;
a top member configured to enclose the housing member; and
a base connector attached to the top member, the base connector having a cavity to house a driver and electronic circuit to drive the light source;
wherein the base connector comprises a Mogul connector, a Medium connector, a Candelabra connector, or a GU24 connector.

16. The lighting device of claim 10, wherein the optic assembly comprises:
a holding member configured to receive the optic, the holding member having a curved outer surface configured to slidably engage a curved surface of the cavity of the housing member to pivot the optic about the light source; and
a telescoping sleeve configured to hold the optic within the holding member, the telescoping sleeve configured to slidably engage an interior surface of the holding member to telescopically adjust the optic within the holding member.

17. The lighting device assembly of claim 10, wherein the optic comprises a plurality of focal points, and the optic is configured to be telescopically moved to position the light source at different ones of the focal points to change a focus of emitted light.

18. The lighting device assembly of claim 17, wherein:

the optic comprises a first focal point within a recess of the optic, and a second focal point outside of the recess of the optic; and the light source is received at the first focal point when the optic is in a compressed telescopic position, and the light source is received at the second focal point when the optic is in an extended telescopic position.

* * * * *